US006102733A

United States Patent [19]

Anderson, Jr. et al.

[11] Patent Number: 6,102,733

[45] Date of Patent: Aug. 15, 2000

[54] RELOCATABLE WIRING CONNECTION DEVICES

[75] Inventors: Ormand Gilbert Anderson, Jr., Canton; Holley Deanne Renfro, Snellville, both of Ga.

[73] Assignee: NSI Enterprises, Inc., Atlantic, Ga.

[21] Appl. No.: 09/451,545

[22] Filed: Dec. 1, 1999

Related U.S. Application Data

[63] Continuation of application No. 08/972,667, Nov. 18, 1997.

[51] Int. Cl.[7] ..... H01R 13/60; H01R 13/66

[52] U.S. Cl. ..... 439/535

[58] Field of Search ..... 439/535, 538, 439/539, 469, 470; 174/59

[56] References Cited

U.S. PATENT DOCUMENTS

| | | | |
|---|---|---|---|
| 1,876,695 | 9/1932 | Kuhn et al. | 439/906 |
| 4,146,287 | 3/1979 | Jonsson | 439/368 |
| 4,464,832 | 8/1984 | Asick et al. | 439/906 |
| 5,553,787 | 9/1996 | Guginsky | 439/535 |
| 5,674,090 | 10/1997 | Sumida et al. | 439/535 |
| 5,679,016 | 10/1997 | Marder et al. | 439/171 |
| 5,679,023 | 10/1997 | Anderson, Jr. | 439/502 |
| 5,819,405 | 10/1998 | Marder et al. | 29/857 |

*Primary Examiner*—Lincoln Donovan
*Assistant Examiner*—Javaid Nasri
*Attorney, Agent, or Firm*—Kenneth E. Darnell

[57] ABSTRACT

Wiring components of a relocatable wiring system including a converter device having respectively identical male and female terminal housings used respectively in male and female ports of the wiring components, the relocatable wiring system formed of the respective wiring components having particular utility in above-ceiling air handling spaces for electrical connection of lighting fixtures inter alia. The converter device forms an interface between hardwiring, such hardwiring being enclosed by a junction box or forming part of a switch, and the relocatable wiring system. Each male port of each wiring component is configured according to the invention to include a male terminal housing including latching structure preferably formed of a plenum-rated polymeric material, each male port having a male terminal housing which is preferably identical to the male terminal housing in each of the other male ports. Similarly, each female port of each wiring component includes a female terminal housing formed of polymeric material with all of the female terminal housings being preferably identical. The male and female terminal housings preferably and respectively mount pin contacts and socket contacts of cooperating electrical terminals in the respective male and female ports to facilitate rapid connection and disconnection of system wiring components. The male and female terminal housings provide structure which snap lock the terminals thereinto and which prevent axial dislodgement of the terminals from the terminal housings. The converter device of the invention is rapidly installable to a junction box or a switch with simple tools from externally of the junction box or switch.

19 Claims, 24 Drawing Sheets

RELOCATABLE WIRING CONNECTION DEVICES

CROSS-REFERENCE TO RELATED APPLICATION

This application is a continuation application of U.S. Ser. No. 08/972,667, filed Nov. 18, 1997, by the present inventors and assigned to the same assignee.

BACKGROUND OF THE INVENTION

1. Field of the Invention

The invention relates generally to wiring components of relocatable wiring systems and particularly to devices connecting said wiring components into such systems.

2. Description of the Prior Art

Electrical wiring for operating lighting fixtures and other circuit loads has long been an art practiced in a variety of similar, basically simple ways. The various forms of "hardwiring" constitute the bulk of present day wiring methods. "Hardwiring" methods typically involve installation of conduits with wire or cable then being pulled through the conduit. In the case of lighting fixtures, these fixtures must then be hung and connected to the electrical system within the conduit so that the fixtures can then be energized. These prior practices require substantial labor costs which typically account for seventy to eighty percent of total electrical installation job cost. Prior wiring systems installed by this conventional "pipe and wire process" has the additional disadvantage that it cannot be used for temporary lighting during facility construction and again for permanent lighting since those materials used in hardwiring processes are usually not reusable. Further, circuitry changes due to layout revision or expansion cannot readily be accommodated in prior art hardwiring systems due to a typical inability when using such prior art systems to reuse those materials which have been cut, such as conduit, for a dedicated circuit arrangement. Relocation of lighting fixtures or other electrical loads in the prior art hardwired systems is thus virtually impossible, it usually being necessary to begin the wiring process anew when fixture relocation is necessary. Prior art hardwiring systems also require that a number of different structural elements be kept in inventory, these structural elements including conduit, wire, couplings, connectors, wirenuts and other miscellaneous materials. Those disadvantages inherent in conventional hardwiring processes are generally obviated through the employment of wiring systems known particularly in the industrial and commercial lighting fields by the mark RELOC which is a trademark of Lithonia Lighting, Inc., a Division of National Service Industries, Inc. of Atlanta, Ga.. The manufactured wiring systems marketed under the mark RELOC facilitate the construction of industrial and commercial installations through the provision of plug-in, relocatable, modular components suitable for commercial wiring, industrial wiring, access floor wiring, local switching and convenient power applications. The primary benefits of the RELOC manufactured wiring systems include reductions in installation time and labor costs as well as easy fixture relocation. Use of these premanufactured relocatable wiring systems can provide labor savings of approximately 75% and total job cost reductions of approximately 25%. The RELOC systems also require a minimum number of inventory components which components can be manufactured with high quality control in a manufacturing facility to meet or exceed the requirements of UL, the National Electrical Code, and CSA.

In U.S. Pat. No. 4,146,287, Jonsson discloses a manufactured wiring system particularly intended in commercial applications to provide power to lighting fixtures mounted in the ceilings of environmental spaces. The commercial manufactured wiring system of Jonsson is typically disposed in the air handling space located above the effective ceiling of the space. In such commercial applications, switching is typically necessary. Further, materials must be employed which are rated as plenum-rated materials.

The present invention improves upon the prior art including the patent to Jonsson by the provision of a relocatable manufactured wiring system which is relatively inexpensive and more easily manufactured when compared to the structures of the prior art.

SUMMARY OF THE INVENTION

The invention provides a relatively inexpensive, rapidly installable relocatable wiring system formed of plenum-rated materials to allow particular use in above ceiling air handling spaces, such use typically being in commercial applications such as office spaces, retail stores and the like. The present locatable wiring system is configured in its component parts to allow rapid and relatively easy manufacture and to be very rapidly installable in a use situation. Primary component parts of the present system attach directly to lighting fixtures or similar loads and are self-grounding. A majority of connections both within and between component parts of the present system involve snap-fitting structure which allow ready manufacture and/or installation. The component parts of the system have rapidly joinable male and female ports which are keyed to prevent connection of component parts having disparate voltage ratings.

The wiring system of the invention particularly includes wiring components including a fixture cable having a female connector head including lead wires connectible directly to ballast leads of lighting fixtures, the female connector head further having a self-grounding fixture spring which holds a ground conductor within the female connector head and contacts the lighting fixture to provide self-grounding. The fixture cable is formed at one end of a metal clad cable which can be cut to length and within which electrical conductors comprising at least one and preferably two hot legs are disposed along with a neutral leg and a ground leg. At the opposite end of the metal clad cable from the female connector head is disposed a male connector head having a male port which connects with female ports of other fixture cables or other wiring components.

The male connector head of the fixture cable and of other wiring components configured according to the invention includes a latch structure which is formed of a polymeric material integral with a male terminal housing which retains electrical terminals comprising pin contacts within a male port of the male connector head. Latching structure of the male terminal housing facilitates positive connection to female ports of other wiring components. Each male port of those wiring components having male ports is provided with an identical male terminal housing. Similarly, each female port of those wiring components having female ports is provided with an identical female terminal housing. Those portions of the male and female terminal housings which snap attach to and hold electrical terminals are of substantially similar configuration.

A wiring component comprised of a length of metal clad cable and having a female connector head at one end and a male connector head at the opposite end is referred to as a cable extender and is utilized to provide additional length at any location within the wiring system.

A wiring component having a female port and known as a converter provides an interface between hardwiring and the wiring system at a junction box or homerun location. The converter has a quick-attach structure which allows rapid attachment of the converter to a knockout of a junction box.

A wiring component known as a drop cable comprises a length of metal clad cable having a male connector head at one end, the opposite end of the cable either simply having wiring conductors extending therefrom or miscellaneous connections such as to other circuits or loads such as exit signs. The drop cable can be provided at the end opposite the male connector head with a snap-in connector allowing rapid installation to a knockout in a component such as a J-box for wiring to hard wired conductors. A similar wiring component is known as a starter/fixture cable and is identical to the fixture cable described above minus the male connector head, said male connector head being replaced by the snap-in connector of the drop cable or simply by the provision of conductors extending from a free end of the starter/fixture cable. The starter/fixture cable intends wiring at the end opposite the female connector head to a junction box or the like.

A wiring component known as a splitter provides two female ports and a single male port in order to separate a branch circuit into two directions. A wiring component known as a switch drop utilizes the basic structure of the splitter with a metal clad cable attached thereto, the free end of the metal clad cable simply having system conductors extending therefrom either with or without a snap-in connector as can be provided at the free end of the drop cable or the starter/fixture cable.

The male and female terminal housings retain electrical terminals within respective male and female ports. The male terminal housings retain electrical terminals having pin contacts while the female terminal housings retain electrical terminals having socket contacts, thereby allowing rapid connection between male and female ports. The male and female terminal housings allow "lay-in" of electrical terminals rather than "push-in" assembly, the electrical terminals snapping into place within the terminal housings and being retained therein against axial dislodgement by structure molded into the housings. The male and female terminal housings further have body portions which are hinged together and which snap together to positively retain electrical terminals therewithin.

Metal housings, particularly galvanized steel housings, of the various system components are assembled together by means of rivets rather than screws in order to allow rapid assembly during manufacture. Keying is provided by the metal housings with control of keying taking place in a manufacturing environment wherein product control can be carefully exercised.

Accordingly, it is a primary object of the invention to provide a relocatable wiring system having wiring components comprising the system, which wiring components have respectively identical male and female terminal housings used respectively in male and female ports of the wiring components, the system having particular utility in above-ceiling air handling spaces for electrical connection of lighting fixtures inter alia.

It is another object of the invention to provide wiring components of a relocatable wiring system and having male and female connector heads which latch together in a snap-fitting fashion whereby an installer has access to the latch and can visually confirm latching of the connector heads together.

It is a further object of the invention to provide quick-connect devices terminating wiring components for holding system conductors and for rapidly attaching to standard knockouts of junction boxes and the like.

It is yet another object of the invention to provide female connector heads of wiring components of a relocatable wiring system, which female connector heads further include fixture connection structure allowing rapid connection of system components directly into lighting fixtures or similar electrical loads.

Further objects and advantages of the invention will become more readily apparent in light of the following detailed description of the preferred embodiments.

DESCRIPTION OF THE PREFERRED EMBODIMENTS

Figure 1:
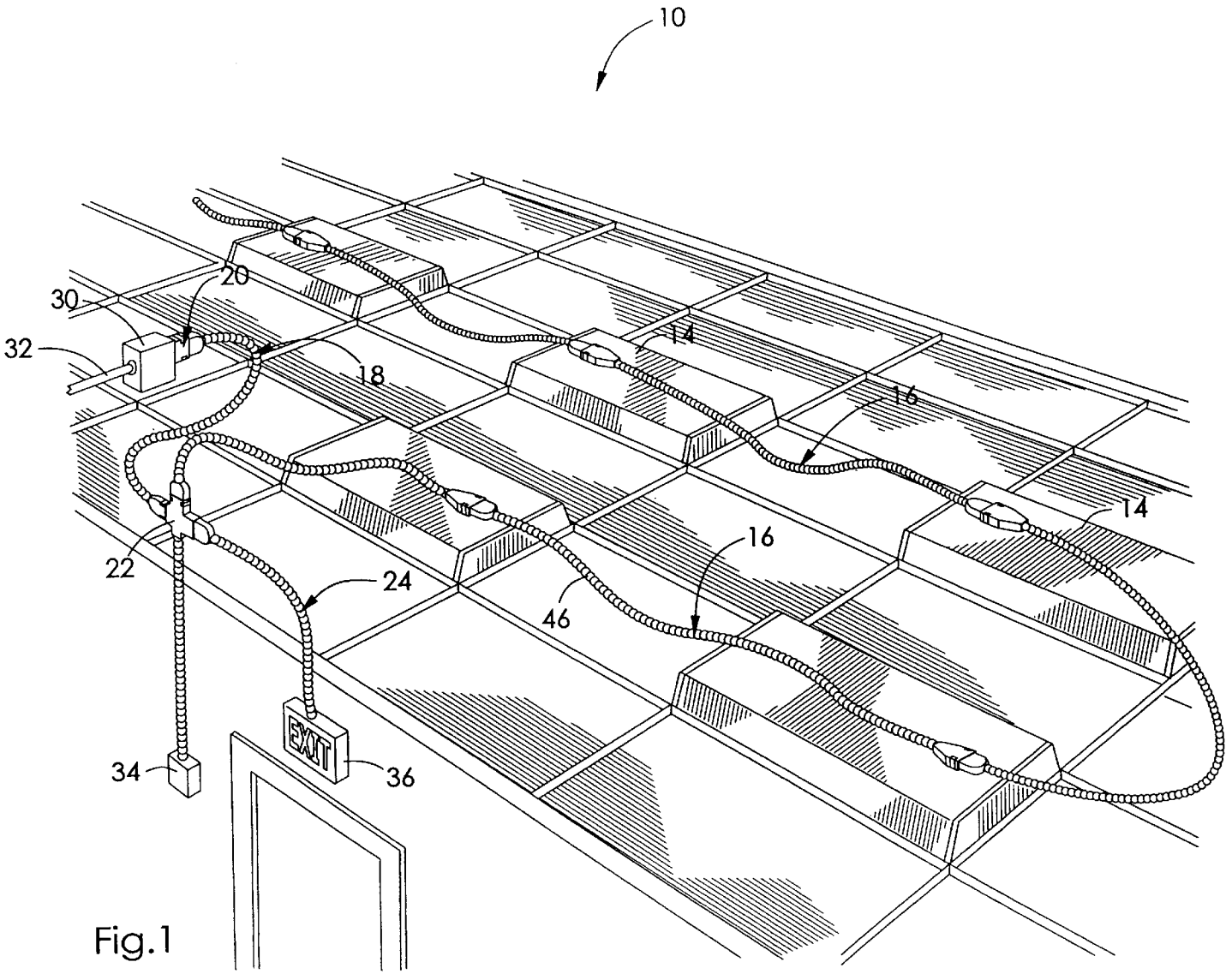
FIG. 1 is an idealized perspective of a relocatable wiring system configured according to the invention and utilizing most of the wiring components comprising the present system.
Figure 2:
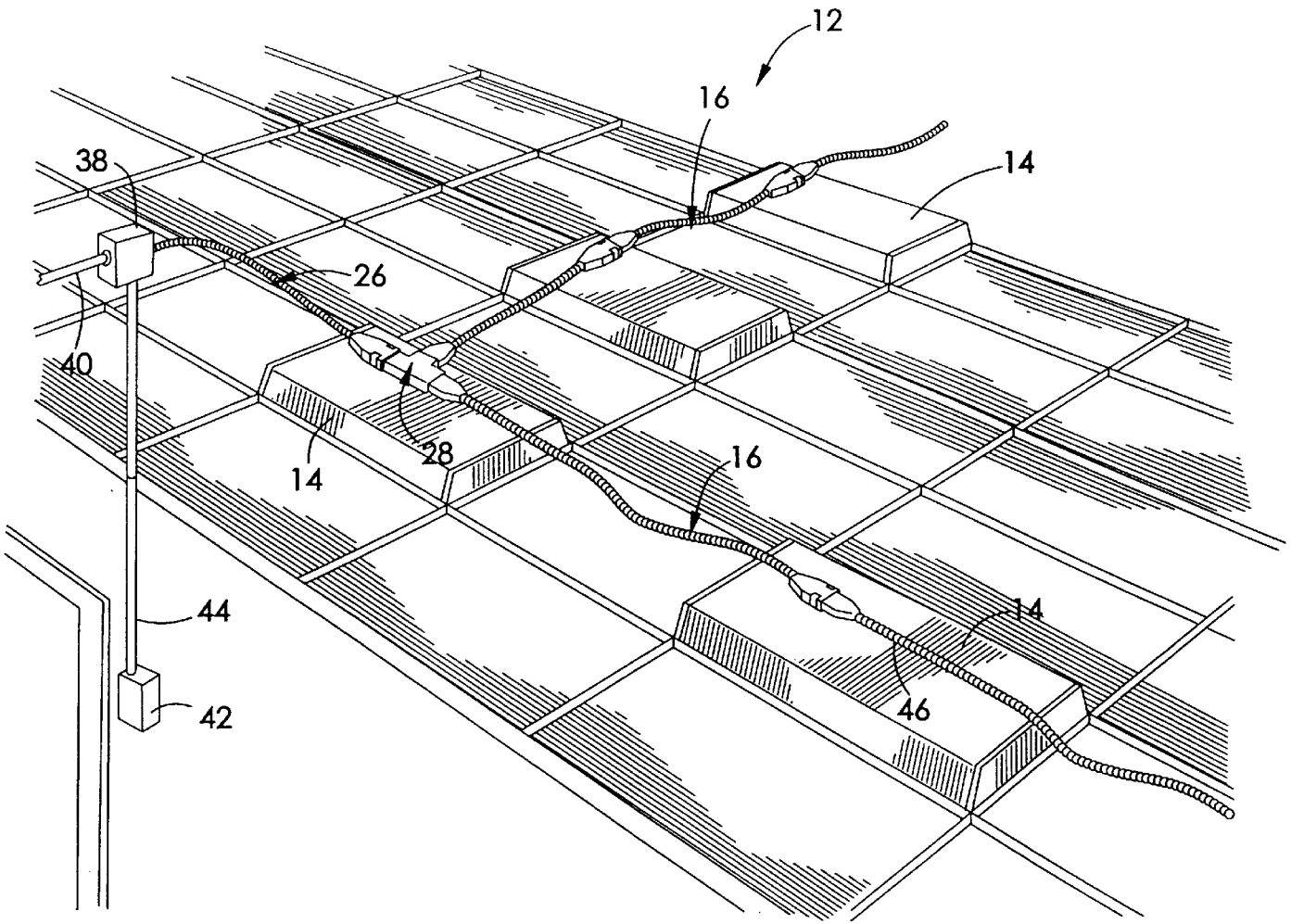
FIG. 2 is an idealized perspective of another relocatable wiring system configured according to the invention and utilizing certain other wiring components not seen in FIG. 1 and certain components which are common to FIG. 1.

Referring to the drawings and particularly to FIGS. 1 and 2, relocatable wiring systems are generally seen respectively at 10 and 12 in FIGS. 1 and 2, both systems 10 and 12 including a plurality of lighting fixtures 14. For ease of illustration, FIG. 1 is provided to show the system 10 while FIG. 2 is provided to show the system 12 wherein the system 10 includes most wiring components comprising the system 12. The system 12 includes certain other wiring components usable in a relocatable wiring system according to the invention. However, two idealized perspective views as provided in FIGS. 1 and 2 are necessary to conveniently illustrate the functions of the several wiring components as well as for illustration of the flexibility and variety of function which can be imparted to a relocatable wiring system by the wiring components of the present invention.

Considering FIG. 1, the system 10 is seen to particularly comprise a plurality of fixture cables 16 which will be described in detail hereinafter. Each fixture cable 16 connects to one of the lighting fixtures 14 and provides a connection port connectible to other fixture cables 16 or to other wiring components of the invention. Although a system may be otherwise configured as will be apparent from the disclosure herein provided, one of the fixture cables 16 connects to a switch drop 22, the switch drop 22 conncecting through a cable extender 18 to a converter 20. The converter 20 electrically and mechanically joins to a junction box 30 which is hardwired to a power source (not shown) through conduit 32 in a conventional manner. The switch drop 22 further connects to a drop cable 24 which connects an electrical load into the system 10, the load conveniently being exit sign 36. The switch drop 22 further connects to a switch box 34 which allows switching of the system 10 in a conventional manner.

Referring now to FIG. 2 in particular, a junction box 38 is seen to be hardwired to a power source (not shown) through conduit 40, the junction box 38 further connecting to a switch box 42 through conduit 44 in a conventional manner. A wiring component of the system 12 not seen in FIG. 1 is shown at 26 to comprise a starter/fixture cable which is wired at a free end into the junction box 38 and which connects at the other end to a modified form of a splitter 28. The splitter 28 can be used to separate a circuit into two directions at any point within a wiring system where such a function is desired and can also be used to provide power to a fixture, for example. The remaining wiring components shown in FIG. 2 are sequentially connected fixture cables 16 which are of a structure identical to those fixture cables 16 shown in FIG. 1.

Use of the wiring components thus described in FIGS. 1 and 2 allow a relocatable wiring system to be panel-switched or locally switched. As can be appreciated from the disclosure provided herein, relocatable wiring systems of virtually infinitely varying description can be assembled using the wiring components herein disclosed, FIGS. 1 and 2 simply being exemplary of two such systems.

The wiring components of the invention which include a "cable" portion utilize a length of metal clad cable 46 seen in FIGS. 1 and 2 and as will be seen in greater detail hereinafter with the exception of the switch drop 22. The metal clad cable 46 is preferably used in the present systems in place of flexible metal conduit (shown in use with the switch drop 22) even though flexible metal conduit is commonly used in relocatable wiring systems. Certain advantages obtain through use of metal clad cable 46 including the fact that metal clad cable can be readily cut to length and is less expensive than flexible metal conduit. It is to be noted, however, that flexible metal conduit could be utilized in place of the metal clad cable 46. A particular metal clad cable 46 useful according to the invention is fabricated by Conductors of Monterrey, a company doing business in Monterrey, Mexico. In the present application, the metal clad cable is wrapped about system conductors (not shown in FIGS. 1 and 2), rather than pushed through conduit as occurs with the use of the hollow conduit which comprises flexible metal conduit. The metal clad cable 46 is typically designated in the industry as MC cable.

Referring now to FIGS. 3, 4 and 5A–5C, the converter 20 is seen to include a female port 48 defined by an outward face of a female terminal housing 50. Details of the female port 48, which details are common to all of the female ports configured according to the invention, will be seen in greater detail hereinafter relative to those figures which show particular details of the female terminal housing 50. The female terminal housing 50 which will be described in detail hereinafter, is mounted between upper and lower housing plates 52 and 54 by means of cylindrical posts 56, a pair of the posts 56 being diposed on opposite sides of the housing 50 with upper portions of the posts 56 being received into circular apertures 58 formed respectively in the plates 52, 54 and spaced from each other. Fitting of the four posts 56 into the four apertures 58 cause the female terminal housing 50 to be positively held in place between the plates 52, 54 on riveting of the plates 52, 54 together through mating apertures 60 formed about the perimeter of each of the plates 52, 54 in flange-like perimetric portions 62 and 78 of said plates 52, 54, respectively the flange-like portions 62 and 78 being substantially identical except as noted hereinafter and thus facilitating mating of the plates 52, 54 together.

Figure 5A:
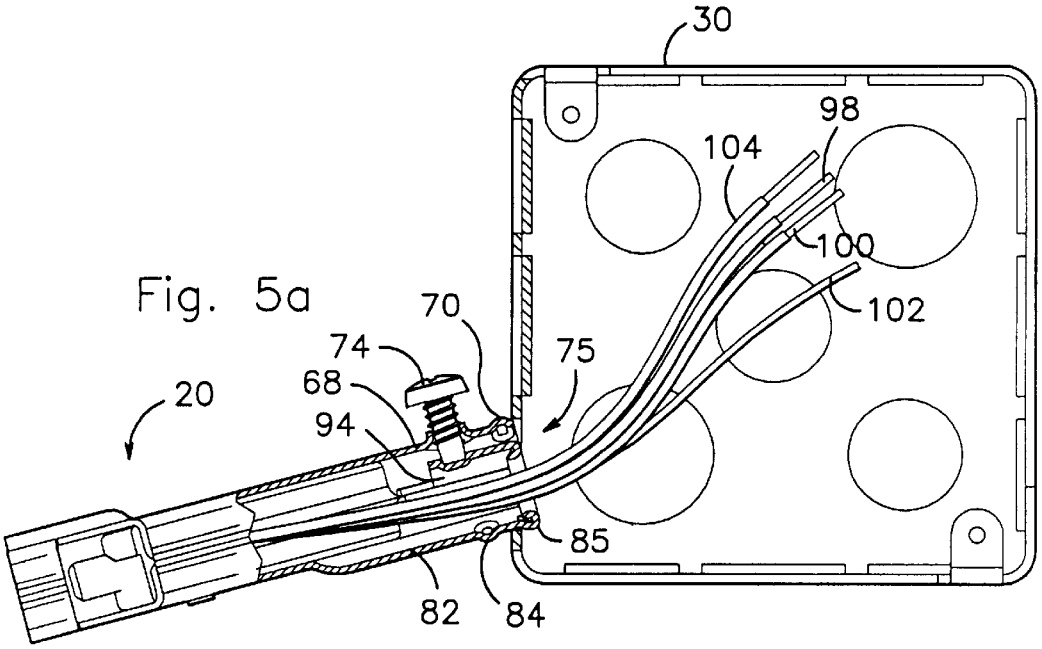
FIGS. 5A and 5B are side elevational views illustrating the mounting of the converter of FIGS. 3 and 4 to a junction box.
Figure 5B:
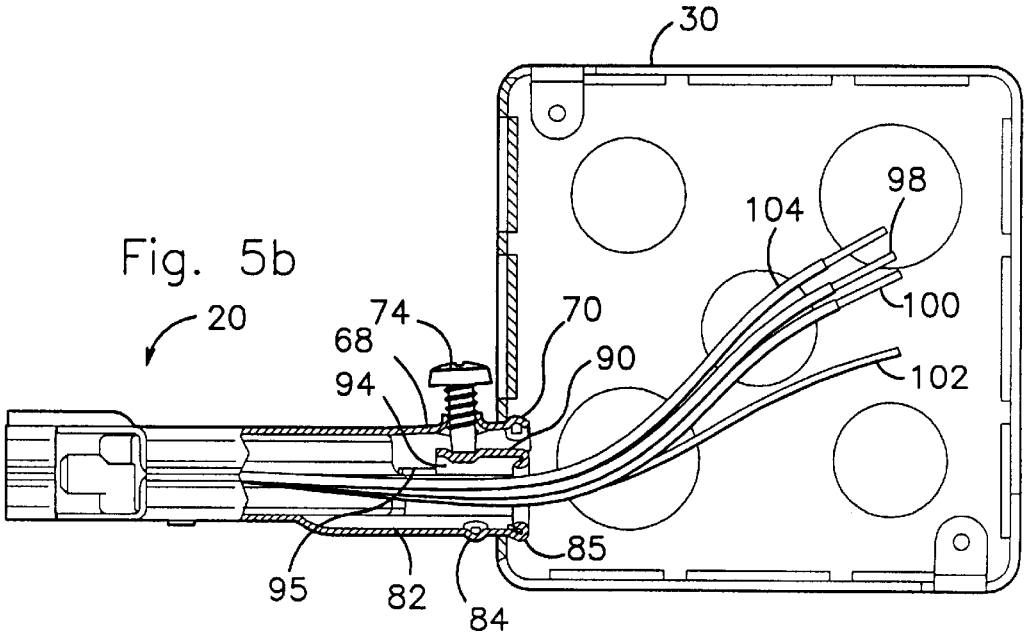

The upper housing plate 52 has a box-like housing portion 64 forming the bulk of the structure thereof, the housing portion 64 being open at the end of the converter 20 within which the female port 48 is defined. The upper housing plate 52 is provided with a keying recess 66 which has a conventional purpose as referred to herein. At the end of the housing plate 52 opposite the open end thereof, an arcuate neck element 68 extends outwardly from the housing portion 64. The neck element 68 has an arcuate rib 70 formed centrally of the arc of the neck element 68, the rib 70 also being arcuate and being raised from the surface of the element 68. A circular opening 72 is punched outwardly from centrally of the neck element 68 and protrudes outwardly from the neck element 68 at a location inwardly of the rib 70 to receive a threaded screw 74. Tightening of the screw 74 within the opening 72 allows rapid connection of the converter 20 to the junction box 30 through a standard knockout 75 as seen in FIGS. 5A and 5B. FIGS. 5A and 5B particularly illustrate this assembly function and will be referred to in greater detail hereinafter. Forwardly of the upper housing plate 52, notches 76 are formed in each lateral side of the plate 52, the notches 76 extending through the flange-like portion 62, through side walls of the housing portion 64 and onto uppermost planar face portions of the housing portion 64. The notches 76 receive latching structure associated with male ports of other wiring components as will be described in detail hereinafter.

Figure 3:
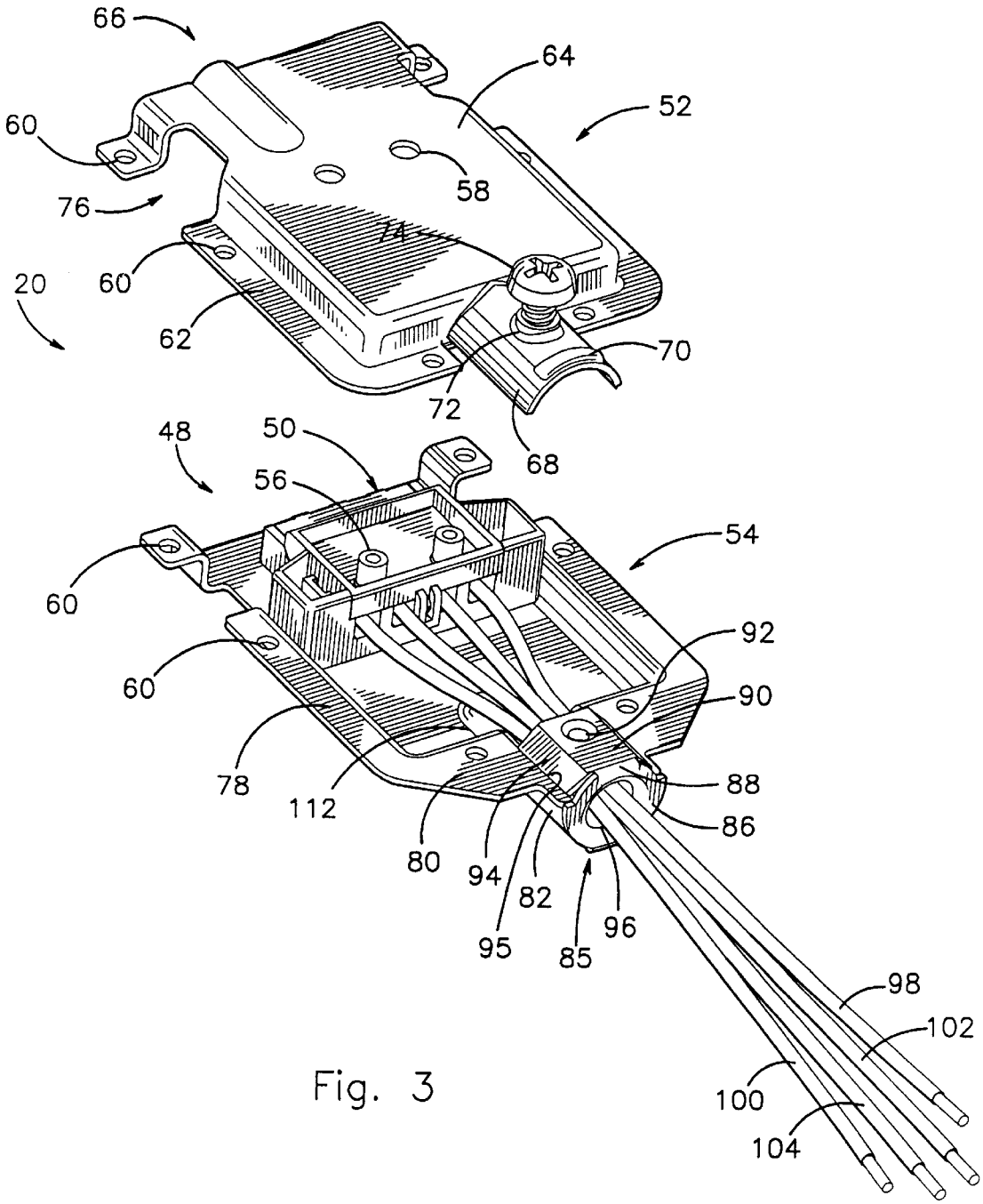
FIG. 3 is a perspective view of a converter wiring component configured according to the invention illustrating the internal structure thereof through removal of an exterior housing plate.
Figure 4:
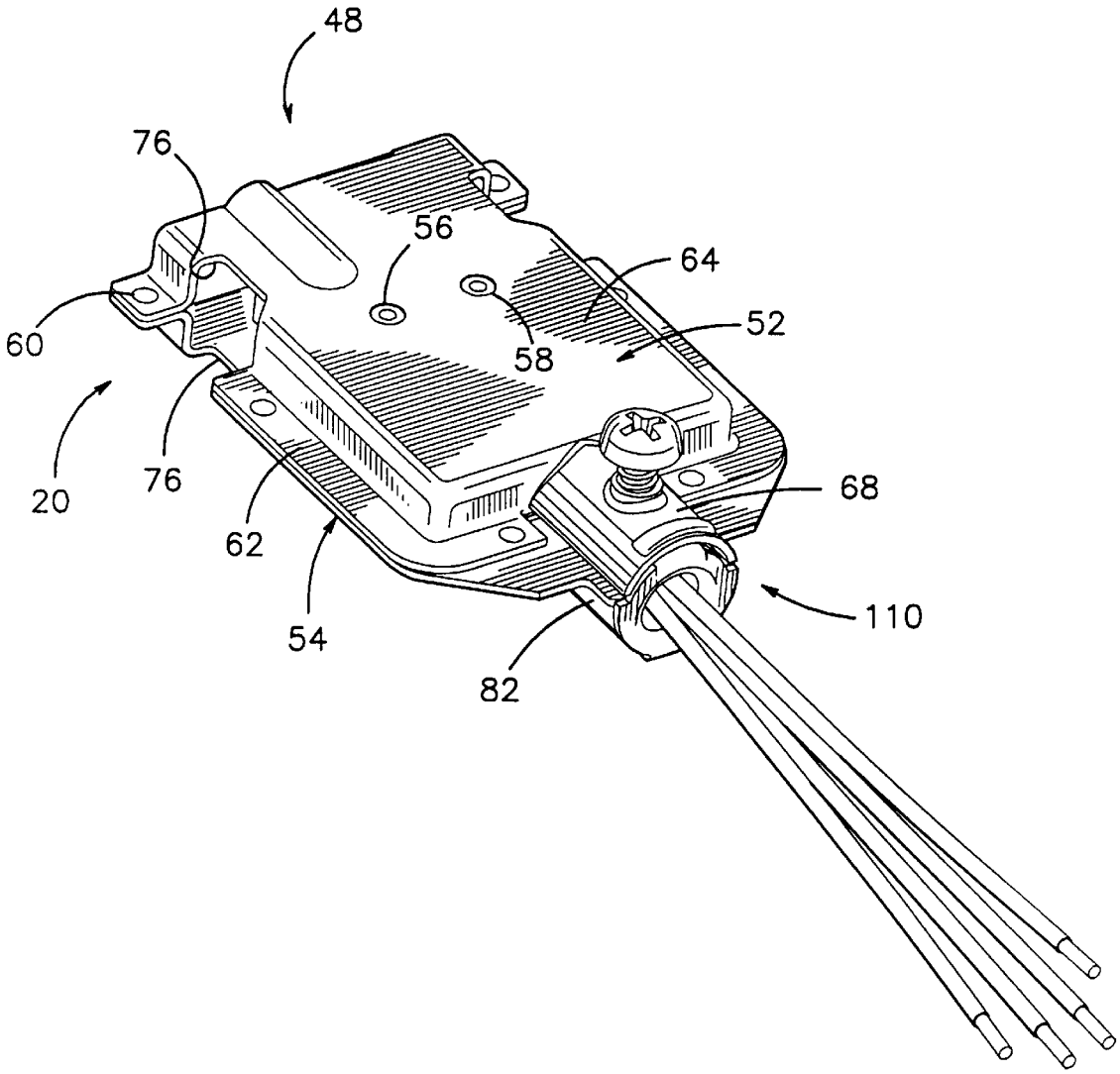
FIG. 4 is a perspective view of the converter of FIG. 3 shown in an assembled configuration.
Figure 5C:
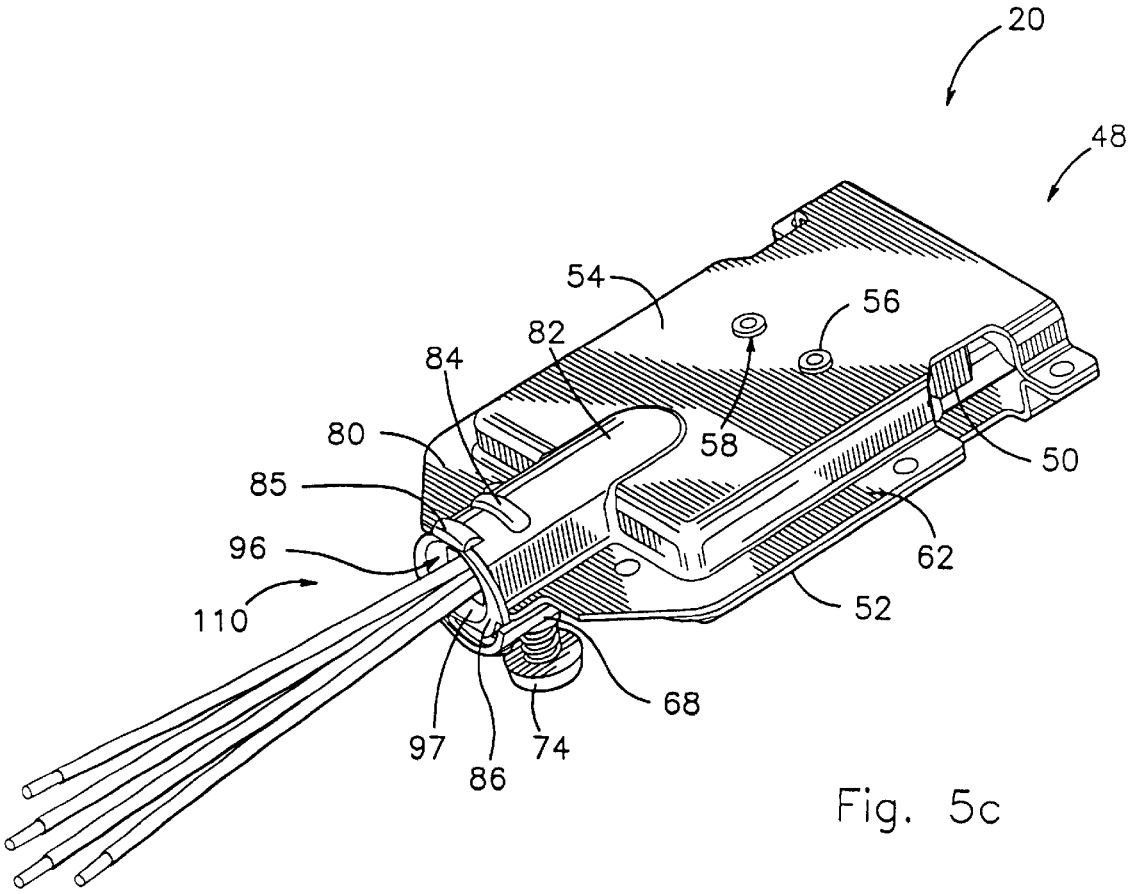
FIG. 5C is a perspective view of the converter of FIGS. 3 and 4 without wiring and shown from beneath in order to reveal structure not apparent from views of the upper portions of the converter.

As can be seen in FIGS. 3 and 4 as well as in FIG. 5C, the lower housing plate 54 is substantially a mirror image of the upper housing plate 52 with the exception that the flange-like portions 78 of the plate 54 which essentially correspond to the flange-like portions 62 of the plate 52 are widened proximally to form a web 80 for purposes of stability, the web 80 curving downwardly on either side thereof to form a partially cylindrical neck element 82, the neck element 82 having an arcuate rib 84 (best seen in FIG. 5C) formed on an outer surface thereof and disposed essentially 180° from the rib 70 as can be seen when the plates 52 and 54 are assembled together. A ramp 85 is disposed at the distal end of the neck element 82. The neck element 82 is open at its free end although this opening is at least partially obscured or closed by a plate-like element 86 which is joined to the neck element 82 by means of a bent portion 88 formed of the same material from which the plate 54 is stamped. At the opposite side of the plate-like element 86 to which the bent portion 88 is connected, a plate 90 joins to the element 86, a plane within which the plate 90 lies being substantially perpendicular to the plane of the plate-like element 86. The plate 90 further has a depression 92 formed centrally therein and arcuate aprons 94 bounding lateral edges thereof. The aprons 94 are not directly connected to the plate-like element 86. The plate 90 and the depending arcuate aprons 94 extend back inwardly toward the lower housing plate 54 and terminate essentially at the periphery of the plate 54. The plate-like element 86 has an enlarged circular opening 96 formed centrally therein, the opening 96 having a punched rolled lip 97 (best seen in FIG. 5C) and receiving system conductors therethrough, these system conductors comprising hot leg conductors 98 and 100, a ground leg conductor 102 and a neutral conductor 104. Ends of the conductors 98, 100, 102 and 104 received within the interior of the converter 20 electrically connect to electrical terminals (not shown) held within the female terminal housing 50, the opposite ends of the conductors 98, 100, 102 and 104 extending through the knockout shown at 75 in FIGS. 5A and 5B. The punched rolled lip 97 obviates the need for a bushing in this location. The assembled and juxtaposed neck elements 68 and 82 extend partially into the knockout 75 formed in the junction box 30 by locating the ramp 85 immediately into the lower edge of the knockout 75 as seen in FIG. 5A. The rib 70 on the neck element 68 is then snapped through the knockout 75, thereby loosely holding the converter 20 to the junction box 30. An appropriate tool (not shown) is then used to manually move the screw 74 inwardly to push the neck elements 68 and 82 apart and thus to engage the converter 20 with the junction box 30 via a wedging action. This wedging action is caused by the inward displacement of the plate 90 causing biasing of the aprons 94 against lateral edges 95 of the cylindrical neck element 82. The arcuate neck element 68 is biased outwardly by the pressure exerted on turning of the screw 74 against the depression 92 formed in the plate 90.

The converter 20, as well as the other wiring components of the invention, is typically rated for use on 20 amp branch circuits with the conductive wires forming the conductors 98, 100, 102 and 104 being No. 12 AWG copper with 90° C. thermoplastic insulation rated 600V. The ground leg conductor 102 is a fully-rated No. 12 AWG grounding conductor which in the converter 20 is provided with insulation but which is a bare wire in remaining portions of the wiring system. The portions of the conductors 98, 100, 102 and 104 extending outwardly of the converter 20 effectively comprise six inch leads which are prestripped approximately 5/8 inch on each for wiring in a conventional manner within the interior of the junction box 30, the junction box 30 essentially corresponding in function to the junction box 30 of FIG. 1. The structure described above as an integral part of the converter 20 and used for connection of the converter 20 to the junction box 30 allows installation of the converter 20 to the junction box 30 without the use of lock nuts or similar connectors, this connection being quickly and efficiently effected to provide substantial savings. Keying provided at 66 is a conventional safety feature which prevents accidental mating of system components rated for different voltages. The upper and lower housing plates 52 and 54 are formed of metal by stamping and typically comprise 18 gauge galvanized steel. Although not seen in FIGS. 1 through 5C, electrical terminals held within the female terminal housing 50 are identical to those used in other wiring components described herein and comprise tin-plated brass contacts such as are conventional with electrical terminals which are of the pin/socket type. The electrical terminals utilized in the converter 20 would be of the socket type and would effectively form major portions of the female port 48.

That structure which acts to mount the converter 20 to the junction box 30 can best be collectively referred to as a fitting 110 which includes the various structural elements providing connection of the converter 20 to the junction box 30. It is further to be noted that the partially cylindrical neck element 82 extends into the lower housing plate 54 to form an arcuate boss 112, the boss 112 providing clearance for the electrical conductors which extend into the interior of the converter 20 as has been described previously. Functioning of the notches 76 in combination with latching structure associated with male ports formed in other wiring components of the invention will be described in more detail hereinafter since the description relative to such other wiring components will essentially be identical to the function and operation of the notches 76 and the latching function thereof seen in FIGS. 3 and 4. Notches also numbered 76 are formed in the lower housing plate 54 and communicate in aligned relation with the notches 76 formed in the upper housing plate 52.

As noted hereinabove, the converter 20 provides an interface between hardwiring and a relocatable wiring system formed according to the invention at a "homerun" location. In essence, conventional wiring methods bring power from a panel, such as through the conduit 32 of FIG. 1 to the junction box 30, that is, the homerun location, or to a switch location where the converter 20 can also be installed in a conventional system fashion.

Figure 6:
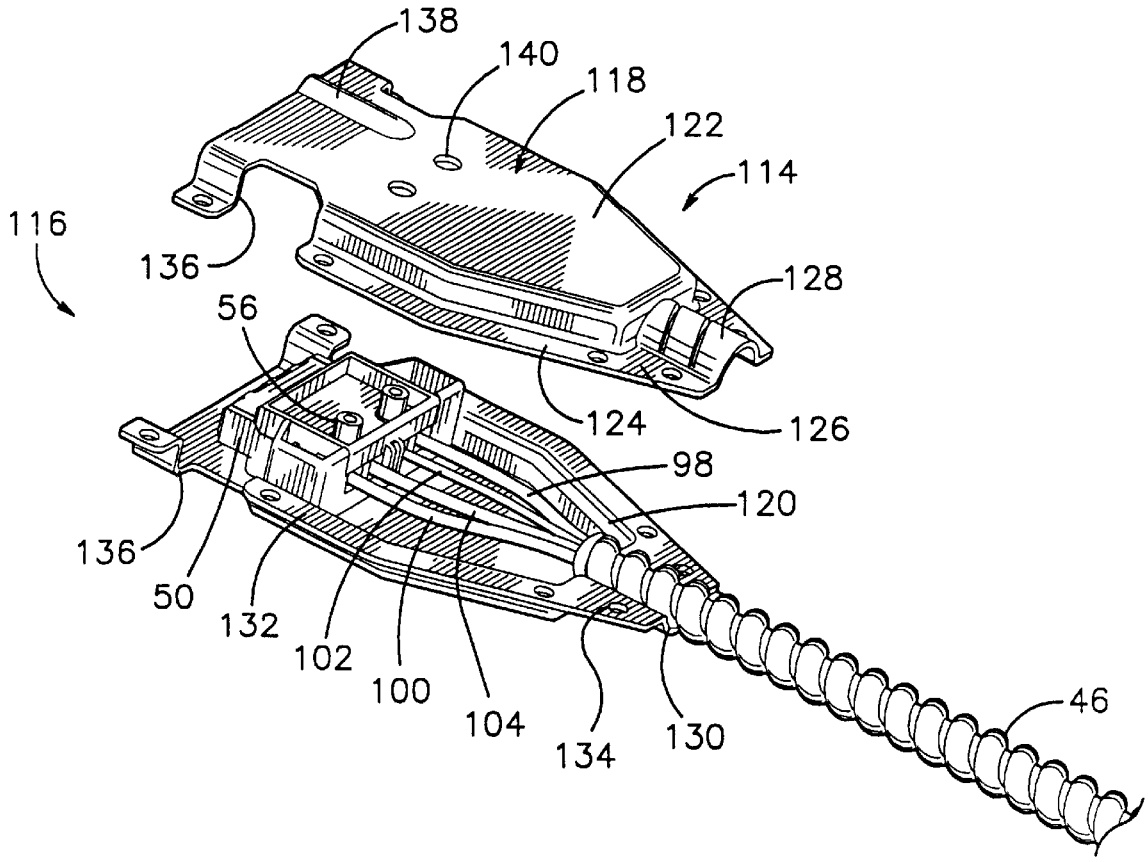
FIG. 6 is a perspective view of a female connector head such as utilized in a cable extender wiring component.

Referring now to FIG. 6, a female connector head 114 connects to a length of the metal clad cable 46 at one end of the said cable 46, the other end of the cable 46 having a male connector head (shown in FIG. 15 inter alia) connected thereto to form the cable extender 18. The female connector head 114 as seen in FIG. 6 is used with only one of the wiring components, that is, the cable extender 18, although a modification of the female connector head 114 is used as portions of other wiring components of the invention as will be described hereinafter. The female connector head 114 defines a female port 116, the female port 116 being structurally and functionally identical to all other female ports described herein including the female port 48 of the converter 20 previously described. One of the female terminal housings 50 which is essentially identical to the housing 50 mounted interiorly of the converter 20 as described herein is mounted between upper and lower housing plates 118 and 120. As indicated previously relative to the description of the converter 20, the female terminal housing 50 of the female connector head 114 is identical in structure and function to all other female terminal housings utilized in all wiring components of the present relocatable wiring systems. Not only does this identity of structure of the female terminal housings portend a somewhat greater efficiency of description herein, it also allows for manufacture and inventory of only one kind of female terminal housing. As noted above, the female terminal housing 50 will be described in detail in relation to those drawing figures which particularly show details thereof. The housing plates 118 and 120 are formed of galvanized steel or the like and have substantial structural similarity to the housing plates 52, 54 of FIGS. 3 and 4. Essentially, the upper housing plate 118 has a primary box-like housing portion 122 which tapers proximally and which is provided with flange-like portions about the periphery thereof, these portions 124 expanding to form a strengthening web 126 at the proximal end of the plate 118. The web 126 carries an integral semicylindrical cable inlet 128 which aligns with a substantially identical cable end at 130 of the lower housing plate 120 to receive an end of the metal clad cable 46 thereinto. The inlets 128, 130 are configured in a conventional manner to have diametrical dimensions which allow the cable 46 to be fitted into openings formed by the inlets 128, 130. The flange-like portions 124 of the upper housing plate 118 align and mate with corresponding flange-like portions 132 disposed about the periphery of the lower housing plate 120, circular openings 134 being formed in the flange-like portions 124 and 132, the openings 134 aligning on assembly of the plates 118, 120 together so that rivets (not shown) can be used to secure the housing plates 118, 120 together. Notches 136 are cut from each of the plates 118, 120 in lateral portions thereof, these notches 136 being essentially the same size and shape as the notches 76 formed in the converter 20. The notches 136 receive latching structure associated with male ports according to the invention and as will be described hereinafter. System conductors essentially identical to the conductors 98, 100, 102 and 104 described relative to the converter 20 extend from the end of the cable 46 into the interior of the female connector head 114 and connect with electrical terminals (not shown in FIG. 6) interiorly of the female terminal housing 50. It is to be noted that the ground leg conductor 102 is a solid bare wire. A keying recess 138 is provided in the upper housing plate 118 for safety purposes as has been previously indicated. The cylindrical posts 56 of the female terminal housing 50 extend into circular apertures 140 to hold the female terminal housing 50 in place in a manner substantially identical to that described relative to the converter 20.

Referring now to FIGS. 7 through 13 inter alia, the female terminal housing 50 is seen in detail. The female terminal housing 50 shown in FIGS. 7 through 13 is an identical structure in all female ports of the various wiring components of the invention and house all electrical socket terminals, that is, female terminals, utilized in the wiring components of the invention. The female terminal housing 50 is formed of a polymeric material which is plenum-rated. Formation of the housing 50 from a polymeric or "plastic" material allows molding of the housing 50 and thus ready formation of structure which facilitates mounting of electrical terminals within said housing 50 and also structural elements which prevent axial dislodgement of electrical terminals from the housing 50.

Figure 10:
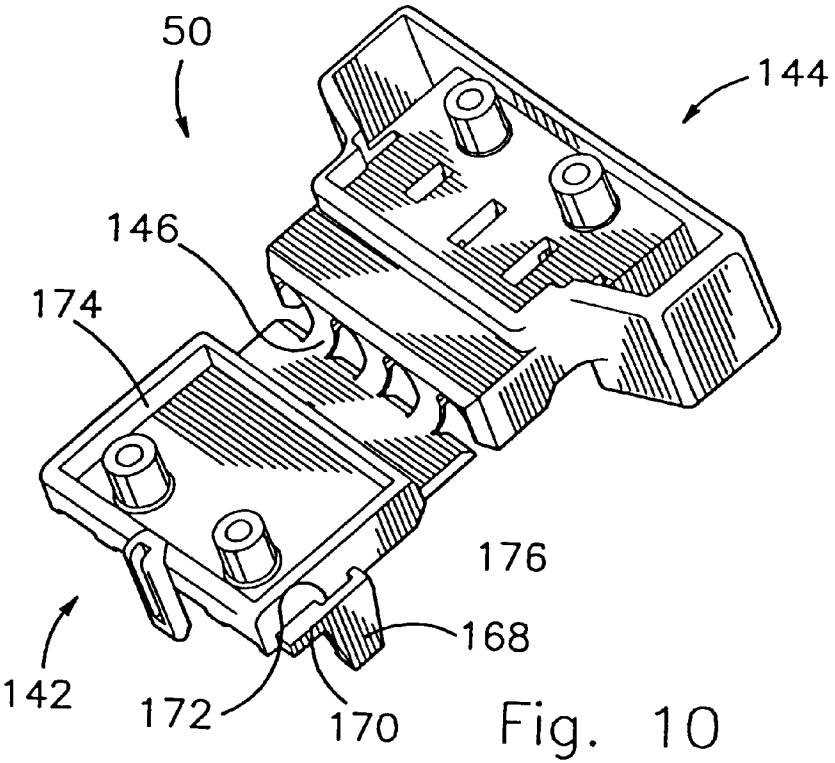
Figure 11:
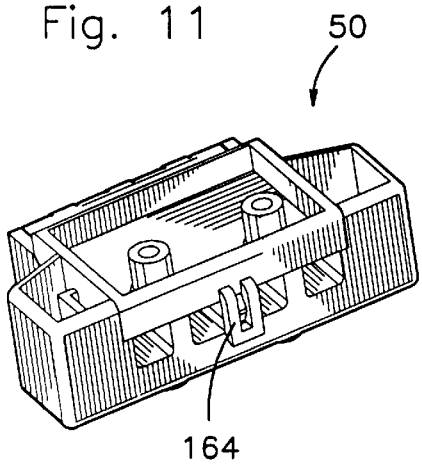
Figure 12:
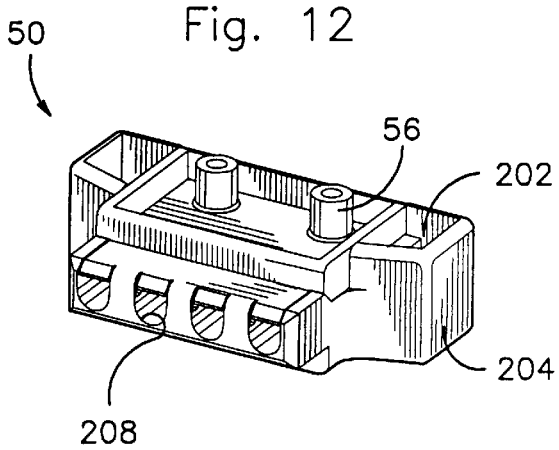
Figure 13:
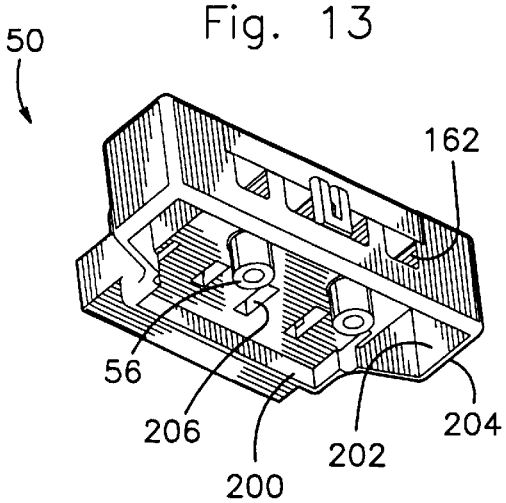

The female terminal housing 50 is seen in FIGS. 7 through 10 to be open, thereby illustrating the two-part structure of the housing 50 and best illustrating internal structural features of the housing 50. FIGS. 11 through 13 show the housing 50 in a closed configuration such as occurs once electrical terminals (not shown in FIGS. 11 through 13) are fitted to the housing 50 and the housing 50 is in a condition to be mounted within the interior of one of the present wiring components. At least one of the female terminal housings 50 is used in each of the wiring components of the invention with the exception of the drop cable 24. In the switch drop 22 and the splitter 28, two of the female terminal housings 50 are used. One of the female terminal housings 50 is used to effectively form each female port of the wiring components of the invention, such as the female port 48 of the converter 20 and the female port 116 of the female connector head 114 as have already been referred to hereinabove.

Figure 8:
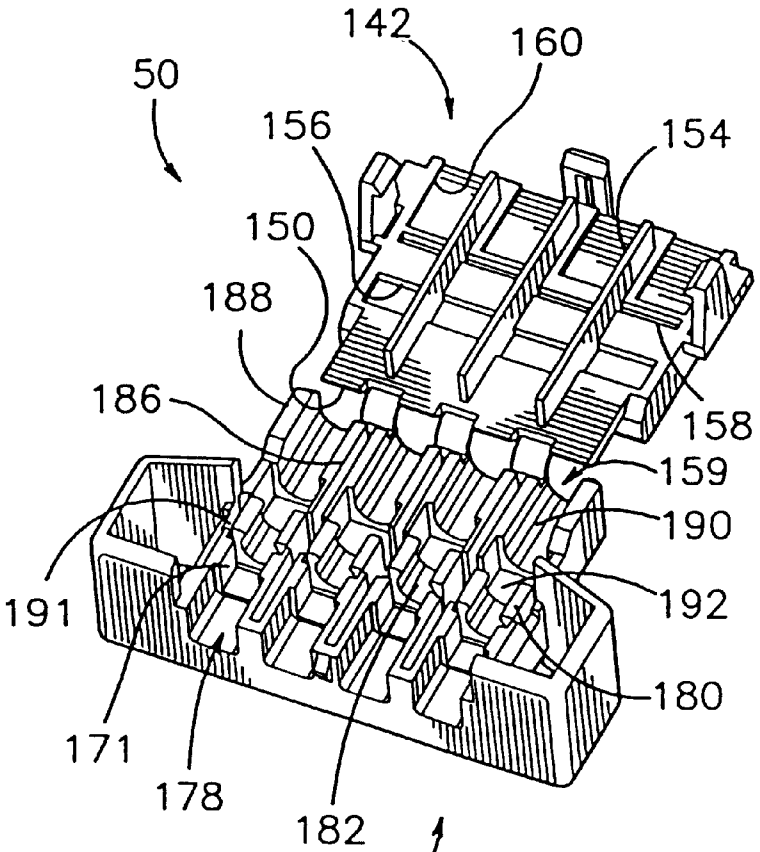
FIGS. 7 through 13 are perspective or plan views illustrating a female terminal housing from varying aspects in order to appreciate the structure thereof.
Figure 7:
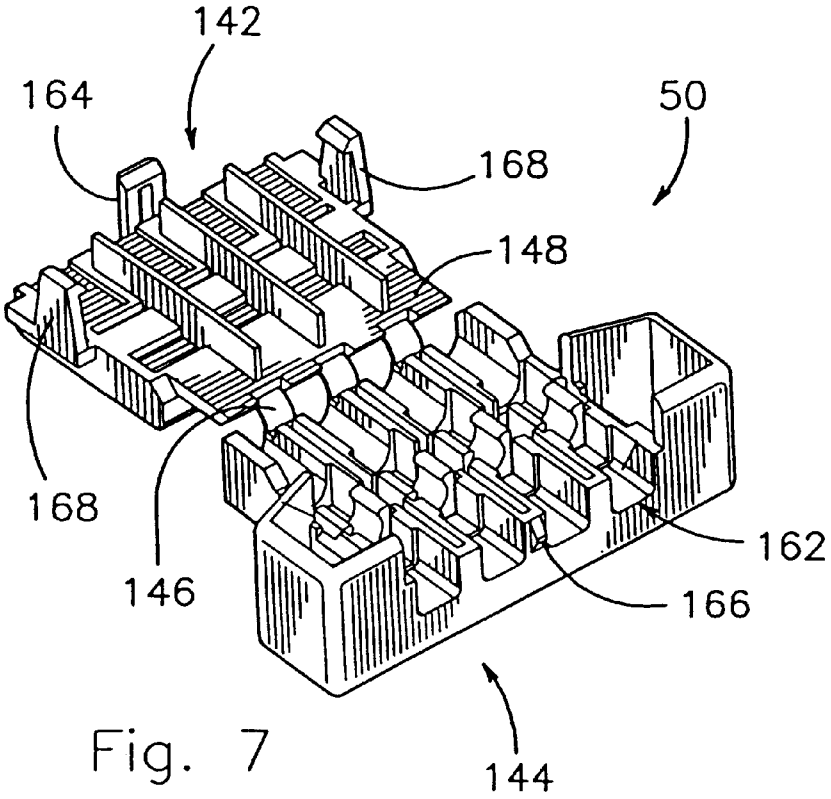
Figure 9:
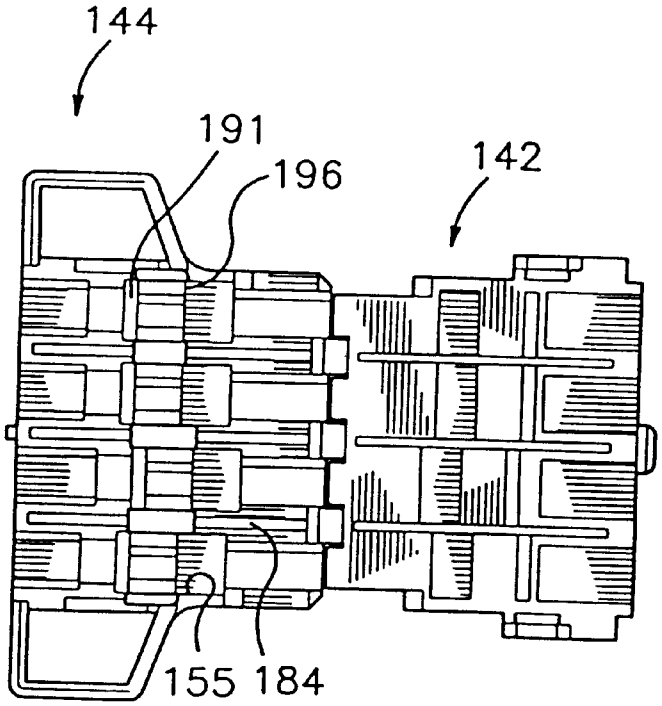

Referring particularly now to FIGS. 7, 8 and 9, it is seen that the housing 50 has an upper body portion 142 and a lower body portion 144 which are held together by means of hinges 146 which are essentially flexible and are formed of the same material from which the housing 50 is molded. The hinges 146 are essentially of that type of hinge often referred to as "living" hinges. FIG. 10 particularly illustrates the hinged connection between the upper and lower body portions 142 and 144. The upper body portion 142 of the housing 50 is seen to comprise a flat planar plate 148 which is substantially rectangular in conformation and which has a beveled trailing edge 150 which is cutaway at regular intervals to form three notches 152 of substantially rectangular conformation. Each of the three notches 152 receive a portion of one of the hinges 146, said hinges 146 joining to the plate 148 integrally such as through formation by a molding process. Each hinge 146 is essentially aligned with one each of three elongated walls 154 which extend perpendicularly to inner surfaces of the plate 148. On closure of the upper body portion 142 against the lower body portion 144, the three elongated walls 154 are received within structure hereinafter described to facilitate definition of chambers within which electrical terminals are held. A series of rectangular indents 156 are formed adjacent to and between the walls 154, the indent 156 surmounting that chamber within which ground leg conductors such as the ground leg conductor 102 connects to a terminal is disposed being located slightly forwardly of the other indents 156 in order to facilitate first electrical contact at the ground position. Rearwardly of the rectangular indents 156 are a series of linear indents 158 with the indent 158 surmounting that terminal connected to a ground leg being forwardly spaced from the remaining indents 158 a distance essentially equal to the forward spacing of the "ground" indent 156 relative to the remaining three indents 156. Behind the indents 158 and adjacent to and between the walls 154 are rectangular indents 160 which are all aligned with their longitudinal axes being essentially perpendicular to the longitudinal axes of the indents 156 and 158. The indents 160 open rearwardly of the housing 50 to partially define substantially rectangular openings 162 from which the respective conductors such as the conductors 98, 100, 102 and 104 extend. It is to be noted that the walls 154 do not extend fully to either forward or rear end of the plate 148. Centrally of the rear end of the plate 148 and aligned with the centrally disposed wall of said walls 154 is a U-shaped snap element 164 which cooperates with a nub 166 formed on the lower body portion 144. The snap element 164 and nub 166 contribute to maintenance of the portions 142, 144 together when said portions 142, 144 are pivoted into contact about the hinges 146. Snaps 168 having inwardly hooked ends fit about and snap against portions of the lower body portion 144 to further facilitate the snap fitting together of the portions 142, 144. The snaps 168 extend from ledge elements 170 extending from either side of the plate 148 near the rear end thereof, each ledge element 170 having a rectangular slot 172 formed therein. The snap 168 can be bent outwardly to disengage the upper body portion 142 from the lower body portion 144. On the outer surface of the plate 148 of the upper body portion 142 of housing 50, a rectangular wall 174 is formed to strengthen the upper body portion 142. Rearwardly of the plate 148 and adjacent to that portion of the wall 174 bounding the rear edge of the plate 148, the cylindrical posts 56 mentioned above extend, the posts 56 being hollowed out as a molding manufacturing expedient.

Figure 30A:
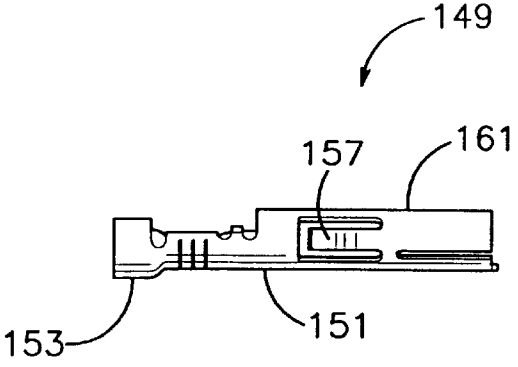
FIGS. 30A and 30B are elevational views of a socket terminal.
Figure 30B:
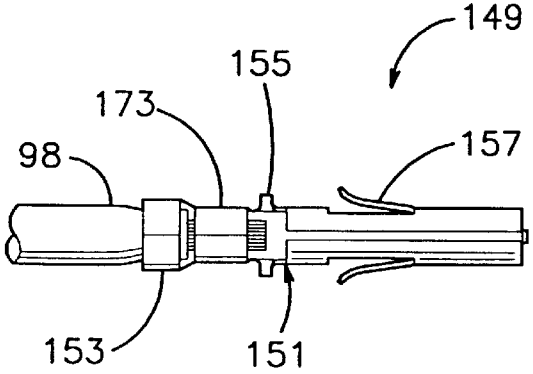

Referring also to FIGS. 30A and 30B which illustrate a socket terminal 149 respectively without an electrical conductor crimped thereto and with an electrical conductor such as the conductor 98 crimped thereto, the socket terminals 149 are conventional in structure and operation and are structured to crimp an electrical conductor thereto in a known manner. Referring also to FIGS. 7 through 10 as well as FIG. 15, the lower body portion 144 of the housing 50 is seen to define four chambers 178 into which the socket terminals 149 (not shown in FIGS. 7 through 13) are inserted by means of a snapping action so that the terminals are positively held in place, this snap-fitting action being primarily provided by a series of substantially aligned, except for a forwardly disposed ground chamber, series of snap arms 180, one pair of the snap arms 180 being provided within each chamber 178 and surmounting a rounded yoke 182 molded into the housing 50. Proximal barrel portions 151 of the terminals 149 respectively fit into the snap arms 180. Tabs 155 extending from the terminals 149 fit respectively into axial slots 191 formed rearwardly of the snap arms 180. Spaces between the pairs of the snap arms 180 align with elongated recesses 184 defined by opposed pairs of walls 186, the walls 186 reducing in thickness at locations just forwardly of the pairs of the snap arms 180 to define spaces 192 within which arcuate tabs 157 fit on placement of the terminals 149 into the chambers 178, free ends of the tabs 157 bias against shoulders 196 of the snap arms 180 to facilitate maintenance of the terminals 149 within the housing 50. The space 192 formed in the "ground" terminal chamber 178 is spaced forwardly of the other spaces 192 which are aligned with each other. The thicker portions of the walls 186 forwardly of the housing 50 define with adjacent walls or with outer walls 188 open-ended forward portions 159 of the chambers 178 having arcuate bottom portions 190. Distal portions 161 of the socket terminals 149 respectively fit into the portions 159 of the chambers 178 and against the bottom portions 190. Open-ended recessed chamber portions 193 located in rear portions of the chambers 178 receive crimped portions 153 of the terminals 149, these crimped portions 153 respectively fitting into the recessed chamber portion 193. Reduced chamber portions 171 receive crimped-in portions 173 of the terminals 149. The ground terminal 149 is located a very small distance forwardly within the housing 50 so that ground connection is made an instant of time faster than are the remaining connections. On closure of the body portions 142 and 144 together, the chambers and spaces referred to above are substantially completed and defined, the terminals 149 thus being positively held within the chambers 178 of the housing 50.

On outer surfaces of the lower body portion 144 as is best seen in FIGS. 10 and 13, a "T-shaped" wall 200 is disposed and integrally formed therewith to provide a positive stop to insertion of the male connector head 212. Leg portions of the wall 200 fills in space within interior portions of the various female ports. Openings 202 are defined by wing portions 204 of the wall 200. The cylindrical posts 56 extend from outer surfaces of the lower body portion 144 near the rear end thereof and adjacent to rear portions of the wall 200. Slots 206 are formed in outer surfaces of the lower body portion 144 and extend into the interior of the housing 50 to locations between the snap arms 180. The slots 206 are present for tooling purposes.

Referring now to FIG. 12, the female terminal housing 50 is seen in an orientation such that U-shaped openings 208 would be disposed forwardly in wiring components of the invention, the effective face of the housing 50 containing said openings 208 effectively forming at least medial portions of each female port of the respective wiring components of the invention. When the housing 50 is wired, the openings 208 receive pin contacts (FIG. 31A and B) of male electrical terminals (FIG. 31A and B) housed in male ports, the pin contacts extending into electrical contact with the appropriate distal portions 161 of the socket terminals 149 housed within the housing 50 as aforesaid, thereby making electrical connection between a female port and a male port.

Figure 14:
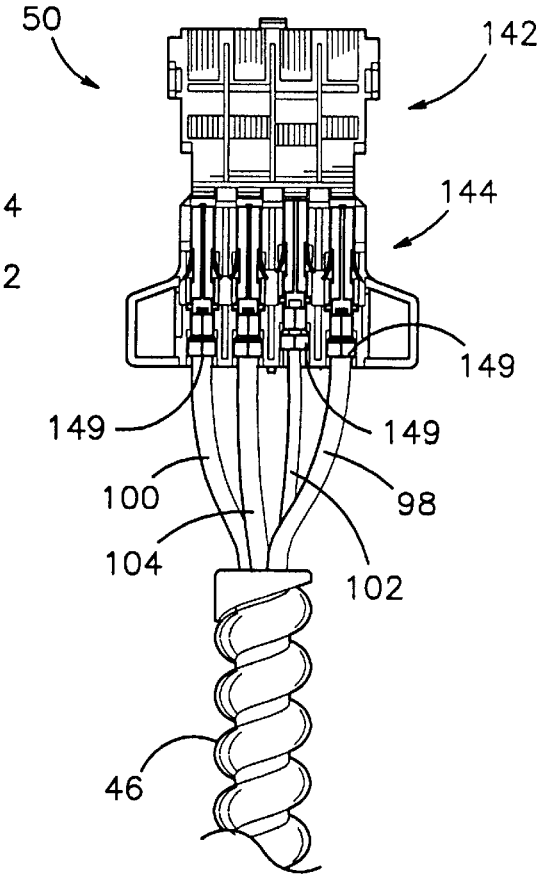
FIG. 14 is a plan view of the female terminal housing in an open configuration and having terminals connected thereto, the terminals being connected to system conductors which extend into another clad cable.

Referring now to FIG. 14, a female terminal housing 50 is shown in an open conformation with four female electrical socket terminals 149 placed respectively into one each of the chambers 178. Conductors 98, 100, 102 and 104 are respectively crimped to the socket terminals 149, the ground conductor 102 being a bare wire. The upper body portion 142 of the housing 50 is pivoted downwardly about the hinges 146 to snap fit to the lower body portion 144 to thereby positively house the socket terminals 149 therewithin. The assembly formed by snap-fitting of the upper body portion 142 to the lower body portion 144 of the housing 50 is used in the converter 20 of FIGS. 3 and 4 to effectively form the female port 48. In the female connector head 114 of the cable extender 18 the housing 50 forms the female port 116 as has been described previously. The assembly of FIG. 14 is further used in the starter/fixture cable 26 to form a female port therein. The starter/fixture cable 26 has a female connector head which is very similar in major respects to the female connector head 114. While the female terminal housings 50 are used in the splitter 28, the assembly particularly shown in FIG. 14 is not used in the assembly of the splitter 28.

Figure 15:
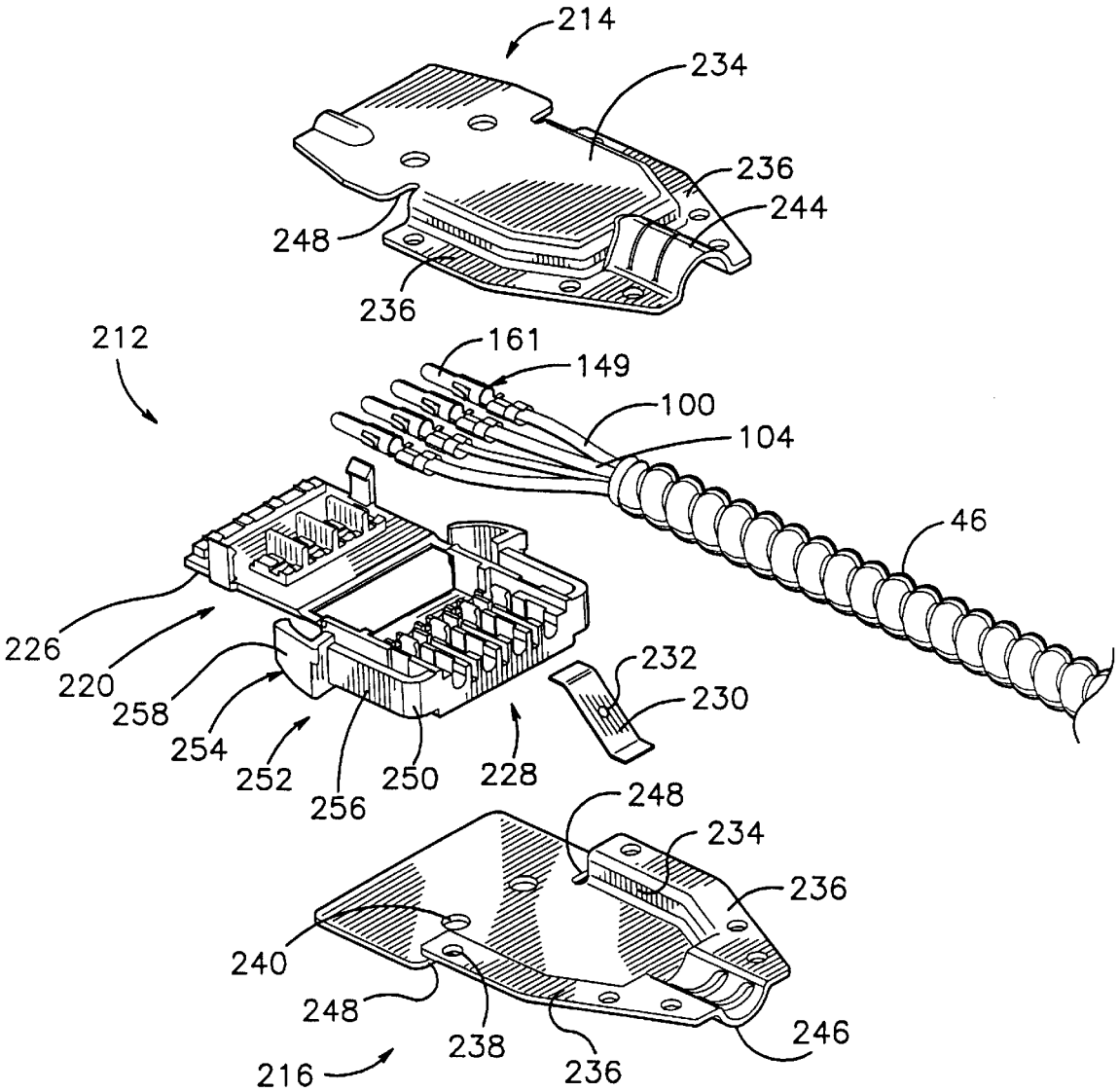
FIG. 15 is an exploded view of a male connector head configured according to the invention.
Figure 16:
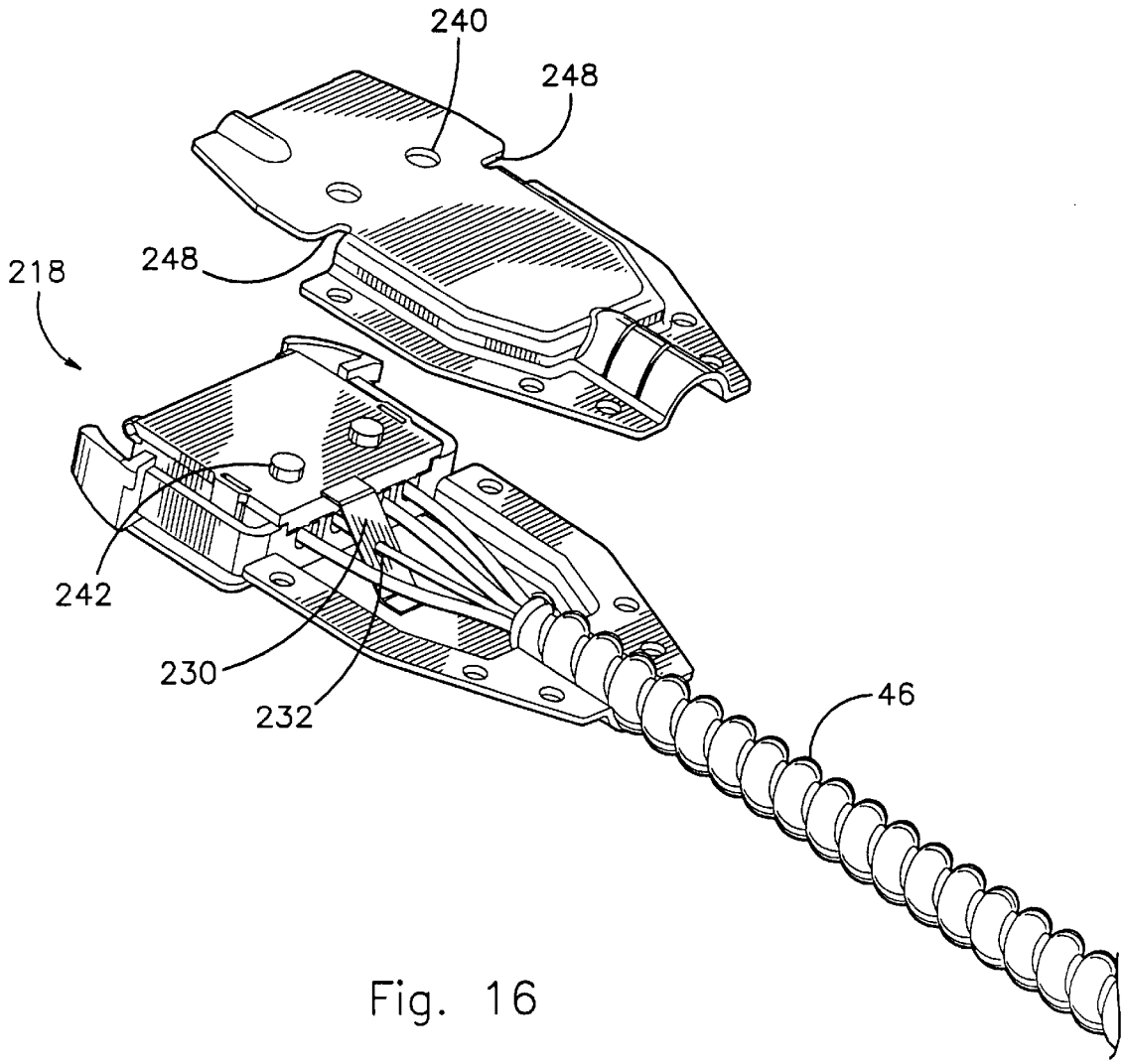
FIG. 16 is a perspective view of the male connector head of FIG. 15 shown in an assembled configuration with the exception of an upper housing plate being removed from the main body of the head in order to illustrate internal arrangements of structure within said head.

Referring now to FIGS. 15 and 16 inter alia, a male conenctor head 212 is seen to be comprised of upper and lower housing plates 214 and 216, the housing plates 214, 216 being stamped from galvanized steel or the like in the manner of formation of the plates 52, 54 of the converter 20 and the plates 118, 120 of the female connector head 114. The male connector head is used to terminate one end of metal clad cable 46 in wiring components including the cable extender 18, the fixture cable 16 and the drop cable 24. The structure thus seen in FIGS. 15 and 16 could be one end of each of the wiring components 16, 18 and 24. System conductors extending from the cable 46 can be numbered 98 through 104 essentially in the same manner as the conductors were numbered in the converter 20 and in the female connector head 114. The corresponding "legs", however, are changed to opposite positions in the male connector head 212. A male port 218 is defined by an open end of the head 212 within which a forward face of a male terminal housing 220 is located. Male electrical terminals 222 crimped to the system conductors 98 through 104 are housed within the male terminal housing 220 with pin contacts 224 of each of the terminals 222 extending within the interior of the male terminal housing 220 toward the male port 218, the pin contacts 224 mechanically and electrically mating with sockets or distal portions 161 of the socket terminals 149 which are disposed effectively in the female ports of the various wiring components of the invention.

Figure 20:
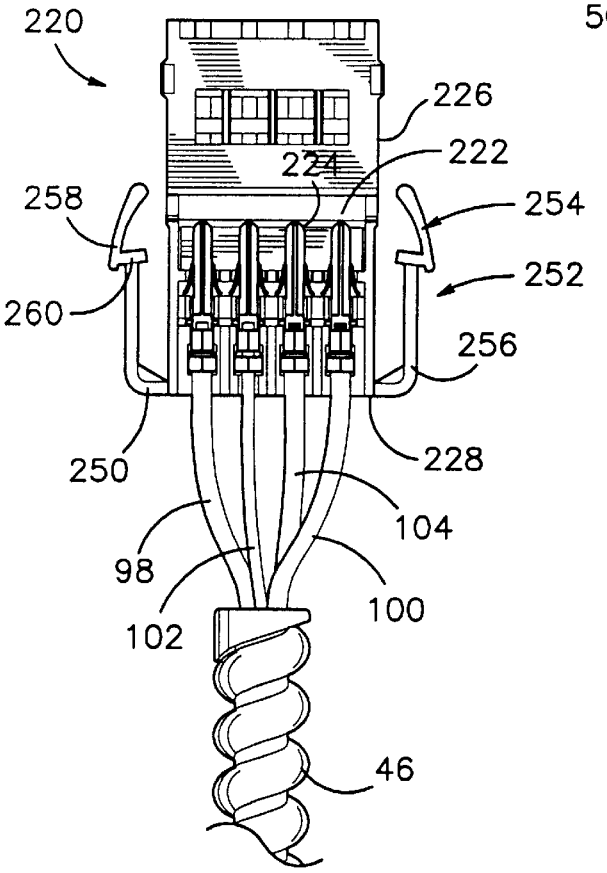
FIG. 20 is a plan view of a male terminal housing in open configuration illustrating the location of electrical terminals attached thereto, the electrical terminals being joined to system conductors which extend into a metal clad cable.

As will be described in more detail hereinafter, the male terminals 222 are received into the male terminal housing 220 and positively retained therein on closure of an upper body portion 226 to a lower body portion 228 of said male terminal housing 220. The assembly of FIG. 20 illustrates the location of the male terminals 222 within the male terminal housing 220 prior to closure of the upper body portion 226 to the lower body portion 228. This assembly of FIG. 20, on closure of the body portion 226 to the body portion 228, is used to form substantial portions of the male connector heads 212 of the cable extender 18, the fixture cable 16 and the drop cable 24. The male terminal housing 22 is also employed to form effective portions of male ports in each of the switch drop 22 and the splitter 28.

As is seen in FIGS. 15 and 16, a ground clip 230 having oppositely angled end portions is provided with an aperture 232 through which the ground leg conductor 102 extends, the ground clip 230 providing excellent electrical contact between the upper and lower housing plates 214 and 216 to ground the male connector head 212. The upper and lower housing plates 214 and 216 are similarly formed with housing portions 234 having flanges 236 extending about rearwardly located perimetric portions thereof, the flanges 236 having apertures 238 formed therein for receiving rivets (not shown) used to secure the housing plates 214, 216 together and hold the male terminal housing 220 therein. The plates 214, 216 are provided with spaced apertures 240 for receiving cylindrical posts 242 which extend one pair each from each side of the male terminal housing 220 for the purpose of properly locating the male terminal housing 220 within the male connector head 212 on assembly of the plates 214, 216 over said male terminal housing 220. The plates 214, 216 are provided at rear portions thereof with mating cable inlets 244 and 246, thereby forming a channel into which the cable 46 extends to place the conductors 98 through 104 within the interior of the head 212 for connection to the male terminals 222 and thus reception into the housing 220.

Each of the plates 214 and 216 are provided with slots 248 on either side thereof for tooling purposes. The slots 248 coincidentally are located in proximity to lateral leg extensions 250 of latch elements 252, the latch elements 252 terminating in hook elements 254. An extended leg 256 connects each hook element 254 to each one of the lateral leg extensions 250. Each of the hook elements 254 are formed of an arcuate element 258 which curves inwardly of the housing 220 to facilitate fitting of the latch elements 252 adjacent a female port such as the female ports 48 and 116 previously described. The arcuate element 258 has a distal edge which is received into the interior of an opening defined by mating open ends of a wiring component such as the female connector head 114 as defined by the upper and lower housing plates 118, 120. The inwardly curving surface of the arcuate element 258 thus allows the male connector head 212, for example, to engage the female connector head 114 or the like until each hook element 244 on either side of the male connector head 212 snap fits into the notches 76, in the case of the converter 20, or the notches 136 in the case of the female connector head 114. The male connector head 212, or any male connector port of the present system components, thus snaps into and locks with a female port, the pin contacts 224 of the male terminals 222 held within the male terminal housing 220 thus mechanically and electrically joining to the socket terminals 149 of the female ports such as the female ports 48 and 116 referred to hereinabove. Shoulder extensions 260 formed at innermost locations of the arcuate elements 258 contact outermost edges of the notches 76 or 136 as aforesaid to thus retain the male connector head 212 to the female port, such as the ports 48 and 116 previously described or any other female port forming a part of a wiring component according to the invention.

Figure 18:
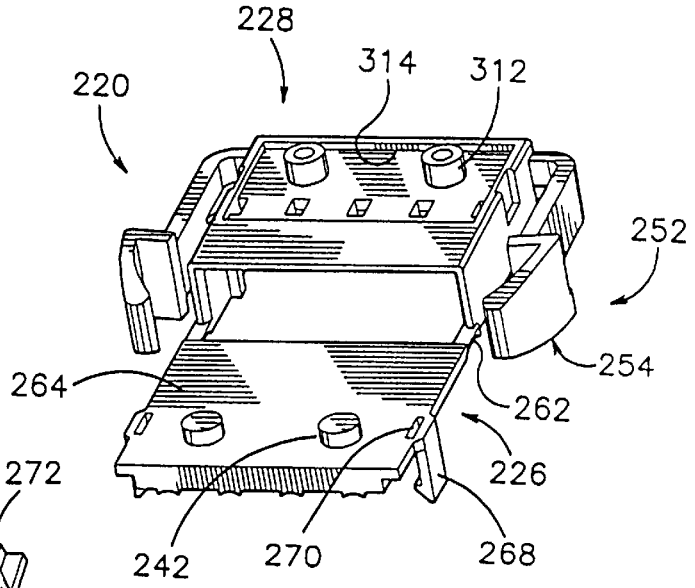
FIGS. 18 and 19 are perspective views from opposite sides of an open male terminal housing.
Figure 19:
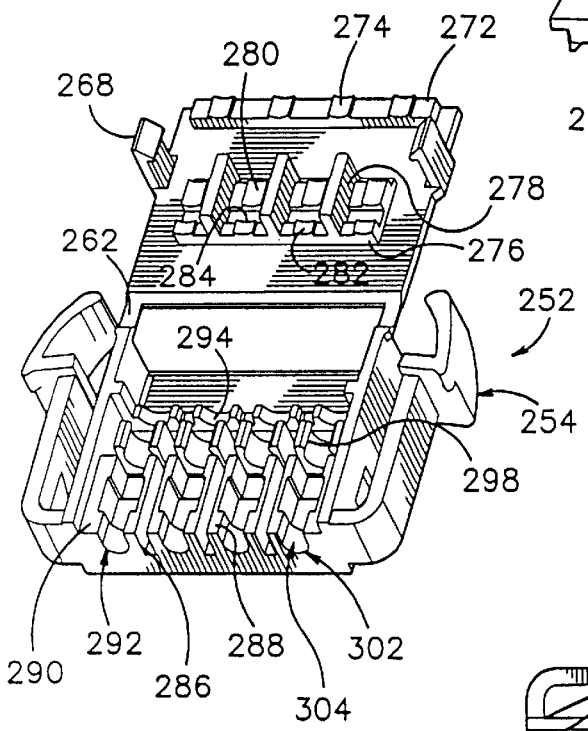
Figure 17:
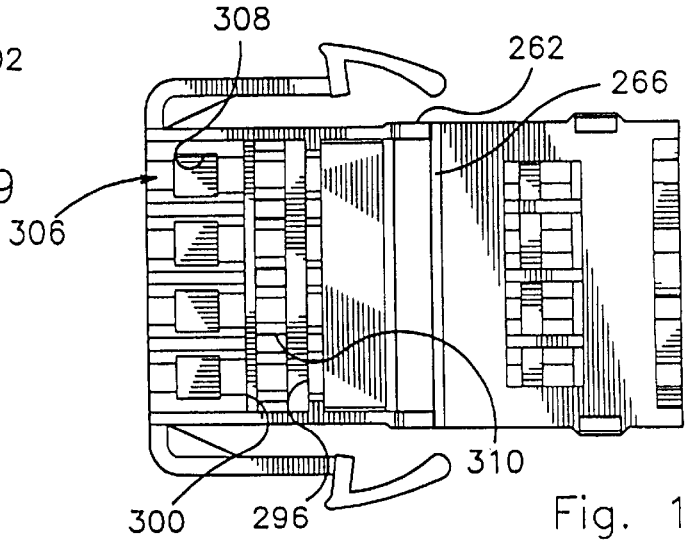
FIG. 17 is a plan view of a male terminal housing shown in an open configuration.
Figure 31A:
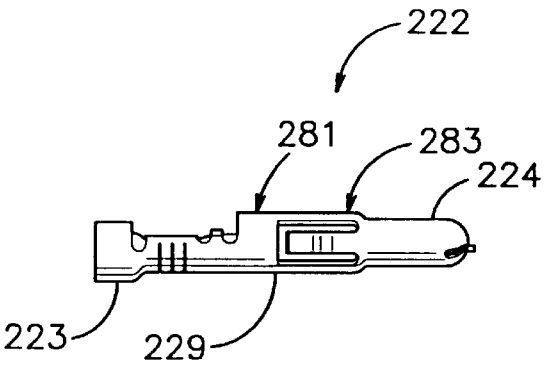
FIGS. 31A and 31B are elevated views of a pin terminal.
Figure 31B:
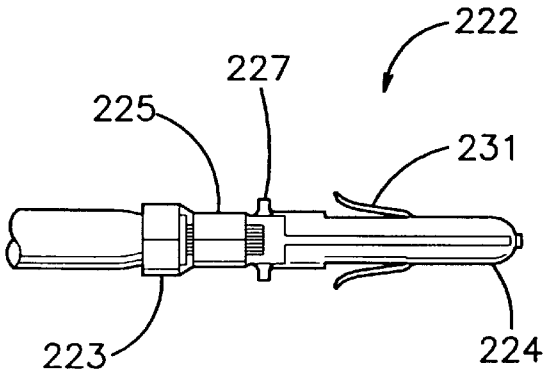

Referring now to FIGS. 17, 18 and 19, as well as to FIGS. 31A and 31B, the male connector head 212 inter alia is shown in greater detail to include the upper and lower body portions 226, 228, hinges 262 joining said body portions 226, 228 such that the upper body portion 226 can pivot relative to the lower body portion 228 for assembly thereof with the male terminals 222 shown in FIGS. 31A and 31B and held within said housing 220. The upper body portion 226 comprises a flat plate 264 having a beveled edge 266. The hinges 262 extend from each lateral side of the body portion 226 into contact with the lower body portion 228. On exterior surfaces of the upper body portion 226, cylindrical posts 242 extend outwardly for purposes described hereinabove. On inner surfaces of the flat plate 226 effectively forming the body portion 226, snaps 268 extend from the plate 264, slots 270 being located at the base of the snaps 268 for tooling purposes. The snaps 268 can be bent outwardly to disengage the body portion 226 from the body portion 228. At a rear edge of the plate 264, a raised bar 272 extends laterally across the plate 264, four arcuate tabs 274 being regularly spaced along the bar 272. The tabs 274 respectively engage portions of the electrical conductors 98 through 104 on closure of the housing 220. Substantially centrally of the inner surface of the flat plate 264, a platform 276 is disposed, the platform having three wall elements 278 extending therefrom at regular intervals. Adjacent to and beween the wall elements 278, spaced groupings of arcuate tabs 280 and 282 are respectively located on each side of a trough 284 which extends laterally across the platform 276. The platform 276 is also reduced in height at the rear ends of the wall elements 278. The arcuate tabs 280 and 282 are aligned with the arcuate tabs 274 and act to engage or surmount the male terminals 222 respectively at locations 281 and 283 on upper surfaces of the terminal 222 as seen in FIG. 31A. The wall elements 278, essentially in the manner of the walls 154 of the female terminal housing 50, fit into recesses 286 defined by spaced walls 288 extending from interior surfaces of the lower body portion 228 and form along with outer walls 290 a series of four parallel chambers 292 which receive the male terminals 222. The fitting of the wall elements 278 into the recesses 286 acts to separate the male terminals 222 and isolate said terminals 222 within the interior of the male terminal housing 220. The chambers 292 are bounded at outer ends by arcuate cradle elements 294 located effectively in the mouth of the male port 218, a trough 296 extending laterally across the lower body portion 228 immediately behind the cradle elements 294, a pair of snap arms 298 being located rearwardly of the trough 296 in each of the chambers 292 so that the male terminals 222 can be snap fit into the chambers 292. A trough 300 laterally extends across the lower body portion 228 immediately behind the pairs of the snap arms 298. Rearwardly of the housing 220, U-shaped openings 302 having arcuate bottom yokes 304 are disposed to terminate the chamber 292. Between the U-shaped openings 302 and the trough 300, recesses 306 indented at 308 allow fitting of crimped portions 223 of the male terminals 222 into the recesses 306 and reduced portions 225 of the terminals 222 into the portions 308, thereby to prevent axial dislodgement of the terminals 222 from the housing 220. Slots 310 extend from an exterior surface of the lower body portion 228 into the interior of the housing 220, for use as a manufacturing expedient. As is also seen on an exterior surface of the lower body portion 228, cylindrical posts 312 extend to mate with corresponding apertures formed in the lower housing plate 216 of the male connector head 212. The cylindrical posts 312 are formed near the rear end of the lower body portion 228 and extend from a recessed planar portion 314 forming major surfaces of the exterior surface of the lower body portion 228.

Tabs 227 extending axially of each of the terminals 222 fit into the trough 300 to further facilitate maintenance of the terminals 222 within the housing 220. Each pair of the snap arms 298 snap-fit onto lower proximal portions 229 of the pin contacts 224 to positively engage the terminals 222. Arcuate tabs 231 extending one each laterally from each of the terminals 222 fit into the trough 296.

Closure of the upper and lower body portions 226 and 228 together causes the male terminals 222 to become fully enclosed one each within each of the chambers 292 as defined herein. The body portions 226 and 228 of the male housing 220 snap-lock together as aforesaid through the expedient of the snaps 268 fitting into rectangular notches 269 formed in the lower body portion 228. The male housing 220 is thus completed with mounting of the conductors 98 through 104 thereto.

Figure 21:
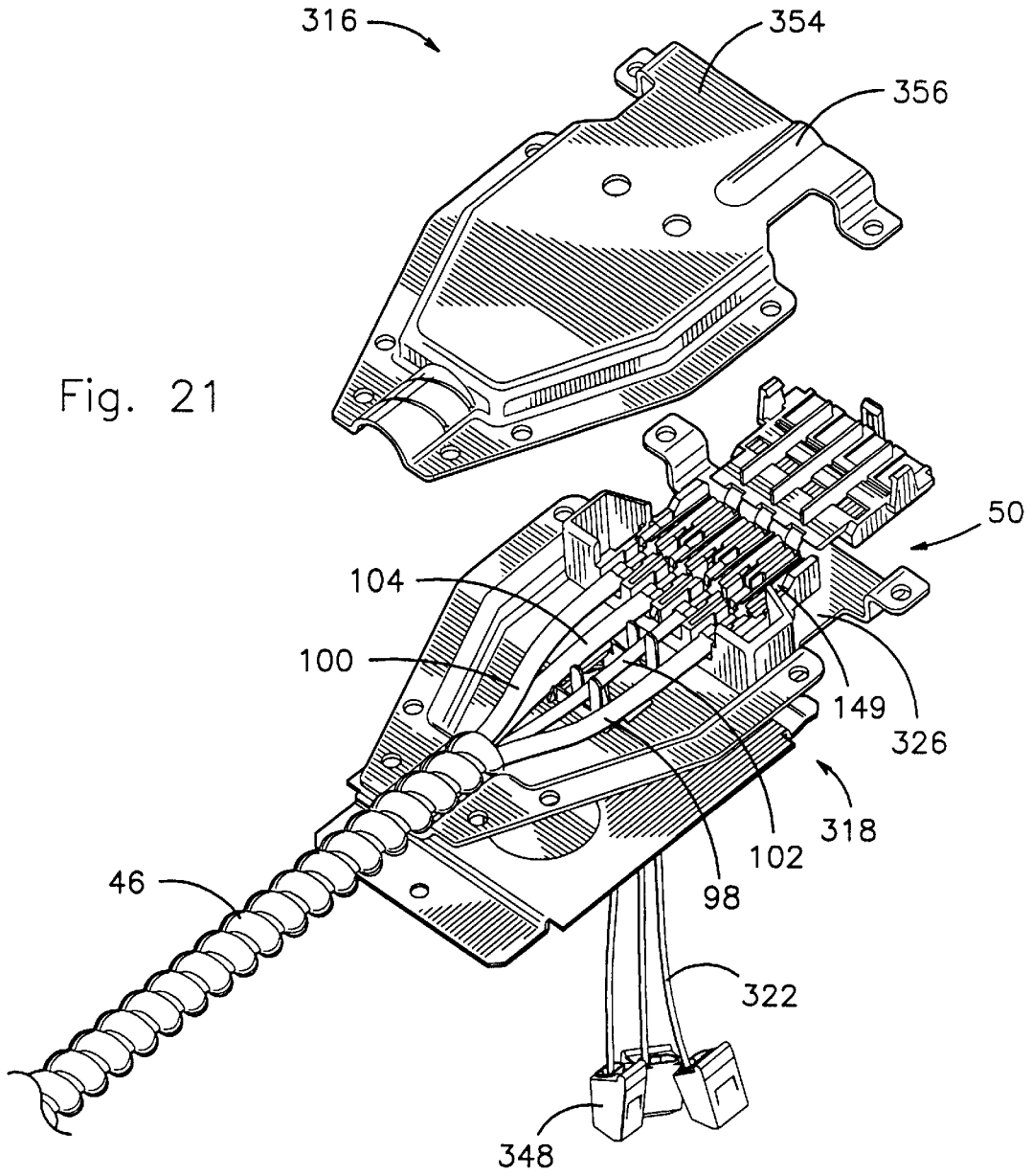
FIG. 21 is a perspective view of a female connector head and fixture connection structure such as is employed in fixture cable and starter/fixture cable wiring components of the invention, an upper housing plate of the connector head being removed and spaced from remaining portions thereof to illustrate internal arrangements of structure within the head.
Figure 22:
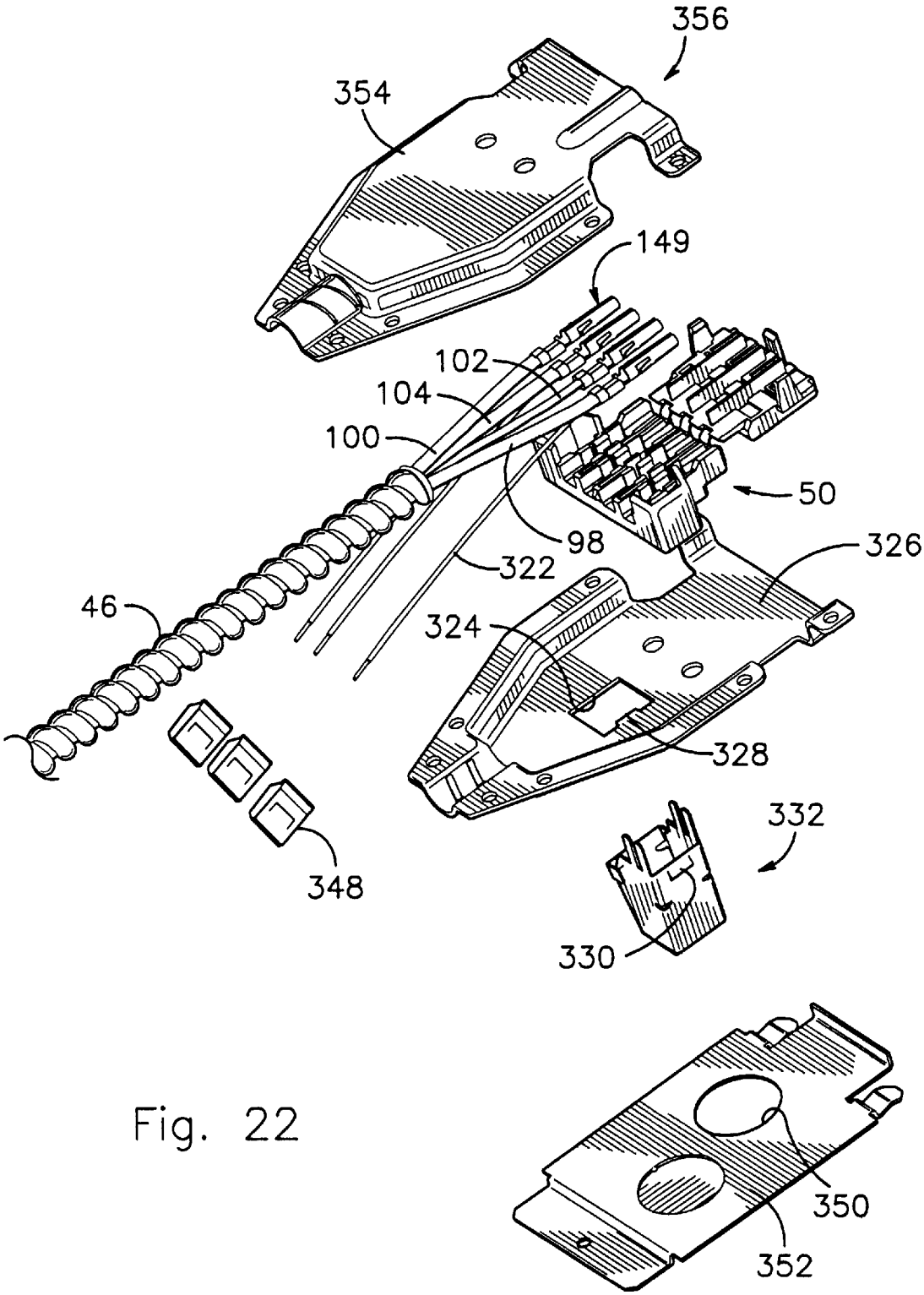
FIG. 22 is an exploded view in perspective of the connector head of FIG. 21.

Referring now to FIGS. 21 and 22 in particular and also to FIGS. 23 through 26, a female connector head 316 having associated therewith a fixture connection assembly 318 is seen to be that structure disposed at one end of the fixture cable 16 opposite one of the male connector heads 212. The female connector head 316 along with the associated fixture connection assembly 318 allows fixture-to-fixture connection of the lighting fixtures 14 in systems such as the systems 10 and 12 of FIGS. 1 and 2 respectively. The female connector head 316 and the associated fixture connection assembly 318 also forms one end of the starter/fixture cable 26, the other end of the starter/fixture cable 26 simply being extended system conductors or a connection device (not shown) such as is manufactured by Arlington Industries, Inc., of Scranton, Pa., under the name "Snap-Tite Saddlegrip Connector", Catalog No. SG38AST. The Arlington Industries connection device connects the starter/fixture cable 26 to a junction box such as the junction box 38 of FIG. 2. This same Arlington Industries connection device terminates the cable 46 of the switch drop 22 for connection to a switch box such as the switch box 34 of FIG. 1. The cable 46 of the drop cable 24 is terminated by this same Arlington Industries connection device for connection to a fixture such as the exit sign 36 of FIG. 1. Since this connection device is conventional, no need exists to describe it herein.

Figure 27:
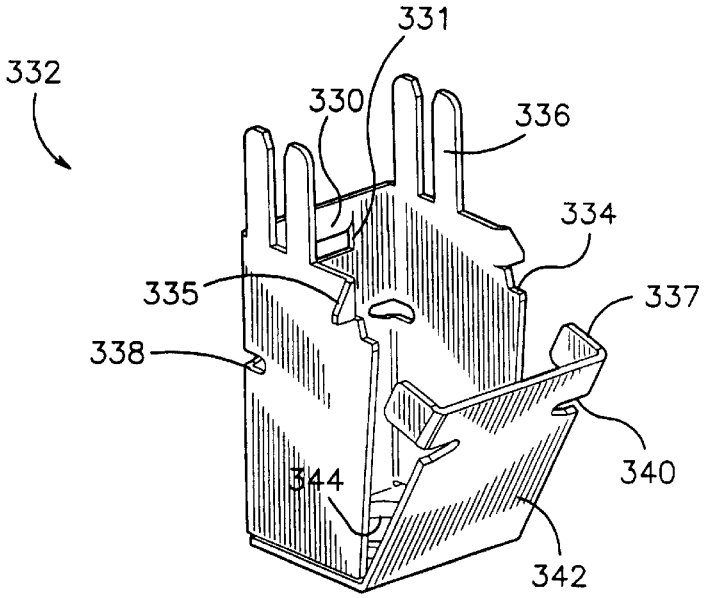
FIG. 27 is a perspective view of a fixture spring forming a portion of the fixture connection structure of the female connector head of FIGS. 23 through 25 inter alia.

The female connector head 316 has a female port 320 at the outward, open end thereof, one of the female connector housings 50 being held within the head 316 in a manner identically to that described relative to the female connector head 114. In FIG. 21, the female socket terminals 149 are shown to be engaged with the lower body portion 144 of the female terminal housing 50. In FIG. 22, the female socket terminals 149 are seen in an exploded relationship with the female housing 50 and are shown to be crimped in a dual fashion, as is conventional, not only to the system conductors but also to 18 gauge lead wires 322 which extend from the female connector housing 50 through a square opening 324 formed in lower housing plate 326, the lower housing plate 326 differing from the lower housing plate 120 of the female connector head 114 by the provision of the square opening 324. A tab 328 extends from one side of the square opening 324 to engage an opening 331 surmounted by a tab 330, the tab 330 being stamped from fixture spring 332, the fixture spring 332 being seen in greater detail in FIG. 27. The tab 330 biases against inner walls of the plate 326 at locations proximous to the tab 328. The fixture spring 332 is prevented from extending more than a short distance into the interior of the head 316, thereby to allow the pairs of upwardly directed fingers 336 to engage the bare wire ground conductor 102 for grounding of the head 316. Slots 338 formed at corners between side walls of the fixture spring 332 and slots 340 formed on opposite sides of flexing wall 342 engage an opening 350 of the access plate 352, the edges of the slots 338 biting into the material of the plate 352. The lead wires 322 extend downwardly through the fixture spring 332 and through opening 344 formed in a bottom wall 346 of the fixture spring 332, the lead wires 322 terminating in pushnuts 348 such as HKL connectors which are known in the art. Lower portions of the fixture spring 332 as well as lower portions of the lead wires 322 and the pushnuts 348 extend through the opening 350 formed in the access plate 352, the opening 350 conveniently being formed by a knockout. Circular edges of the opening 350 fitting into the slots 338 and 340 as aforesaid act to locate the access plate 352 relative to the female connector head 316 and to allow rotation of the access plate 352. The access plate 352 is a standard plate which covers an opening (not shown) in one of the lighting fixtures 14, the access plate 352 being provided as a portion of the fixture connection assembly 318 so that the plate 352 is in position for immediate connection to the lighting fixture 14 once the pushnuts 348 are connected to leads (not shown) from lamp ballasts disposed within each of the lighting fixtures 14. The flexing wall 342 flexes outwardly from the main body of the fixture spring 332 to positively engage the access plate 352. Tabs 335 and shoulders 334 engage peripheral portions of the opening 324 to hold the fixture spring 332 in place along with the stabilizing function of the tab 328 fitting into the opening 331. Tabs 337 insure fitting of the flexing wall 342 into place. The lead wires 322, the fixture spring 332, the pushnuts 348 and the access plate 352 comprise the fixture connection assembly 318 and, along with the square opening 324 as aforesaid and the dual crimping of the lead wires 322 to the terminals 149 essentially provide the differences between the female connector head 114 and the female connector head 316 having the associated fixture connection assembly 318. The female connector head 316 is completed by the provision of an upper housing plate 354 which is essentially identical to the upper housing plate 118 of the female connector head 114. The female connector head 316 is keyed at 356 for safety purposes as has been described hereinabove relative to other wiring components of the invention.

Figure 23:
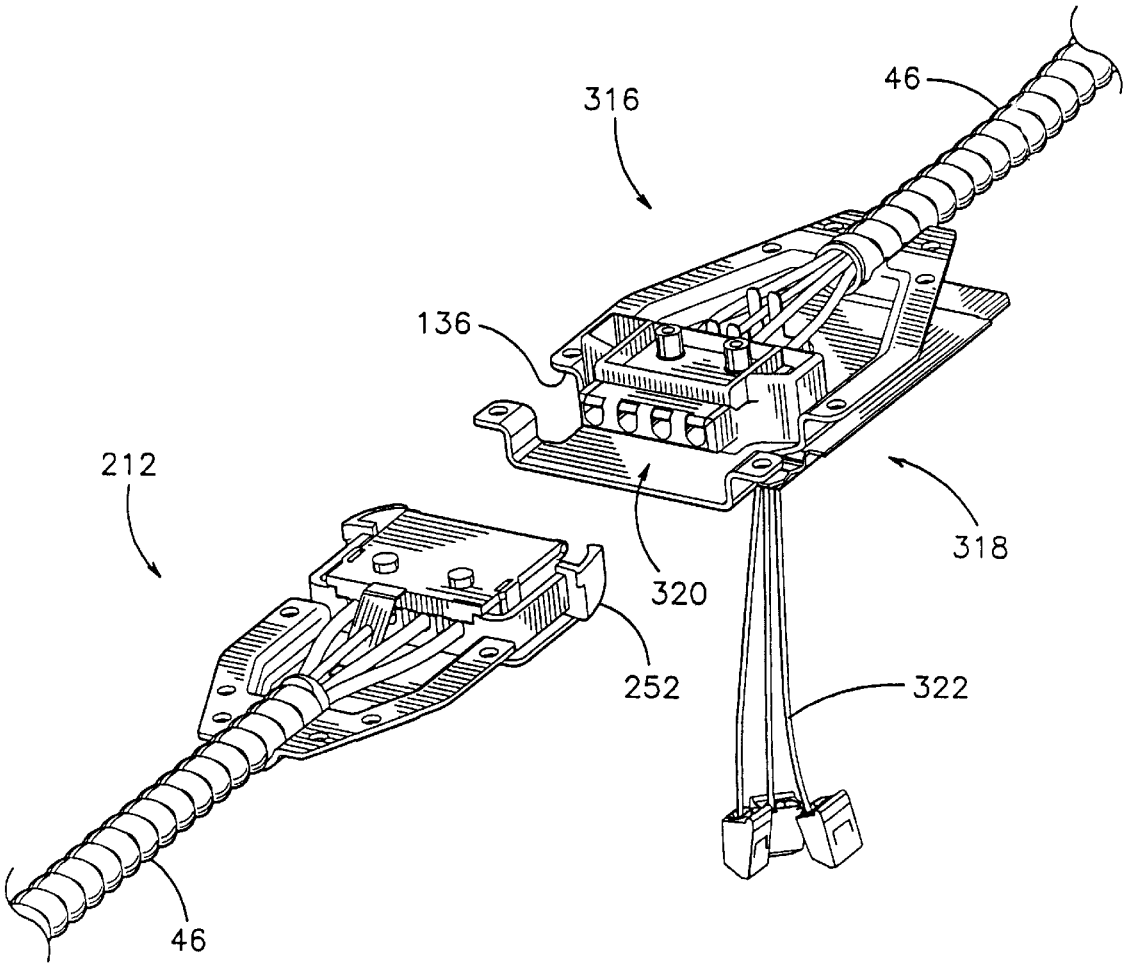
FIG. 23 is a perspective view of a male connector head and a female connector head having fixture connection structure in a juxtaposed arrangement prior to connection, the heads having upper housing plates removed therefrom to provide a greater degree of illustration of internal structure of the respective heads.
Figure 24:
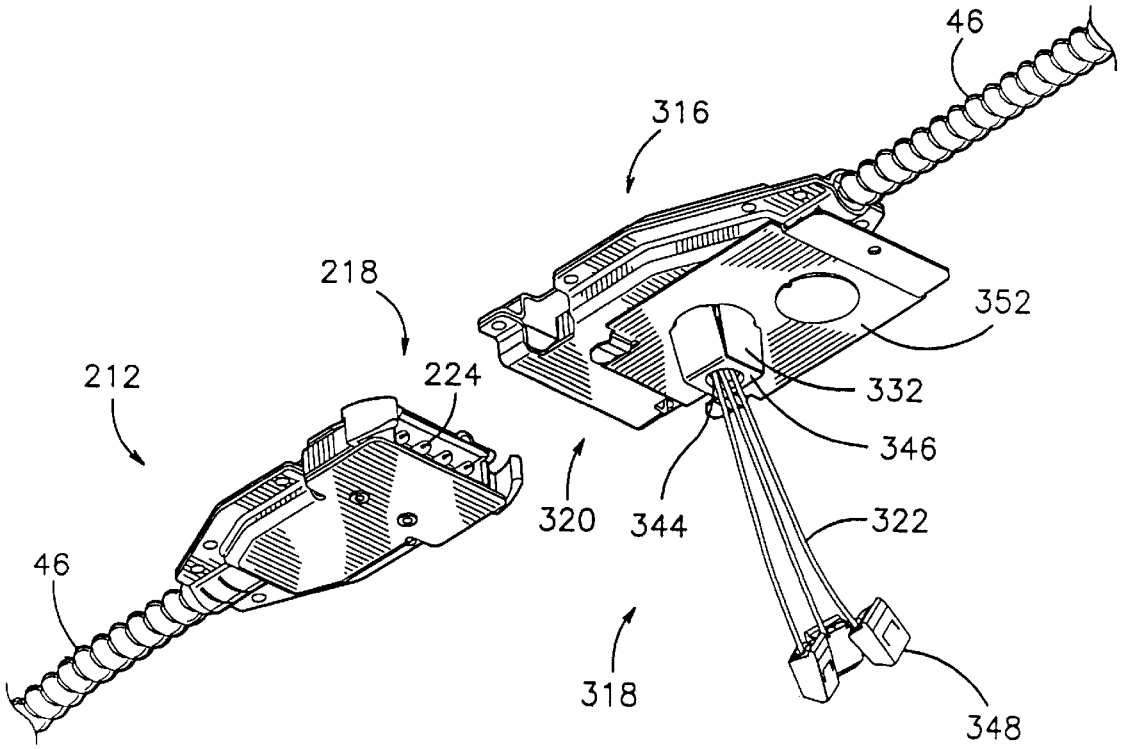
FIG. 24 is a perspective view of the heads of FIG. 23 shown from beneath the heads.
Figure 25:
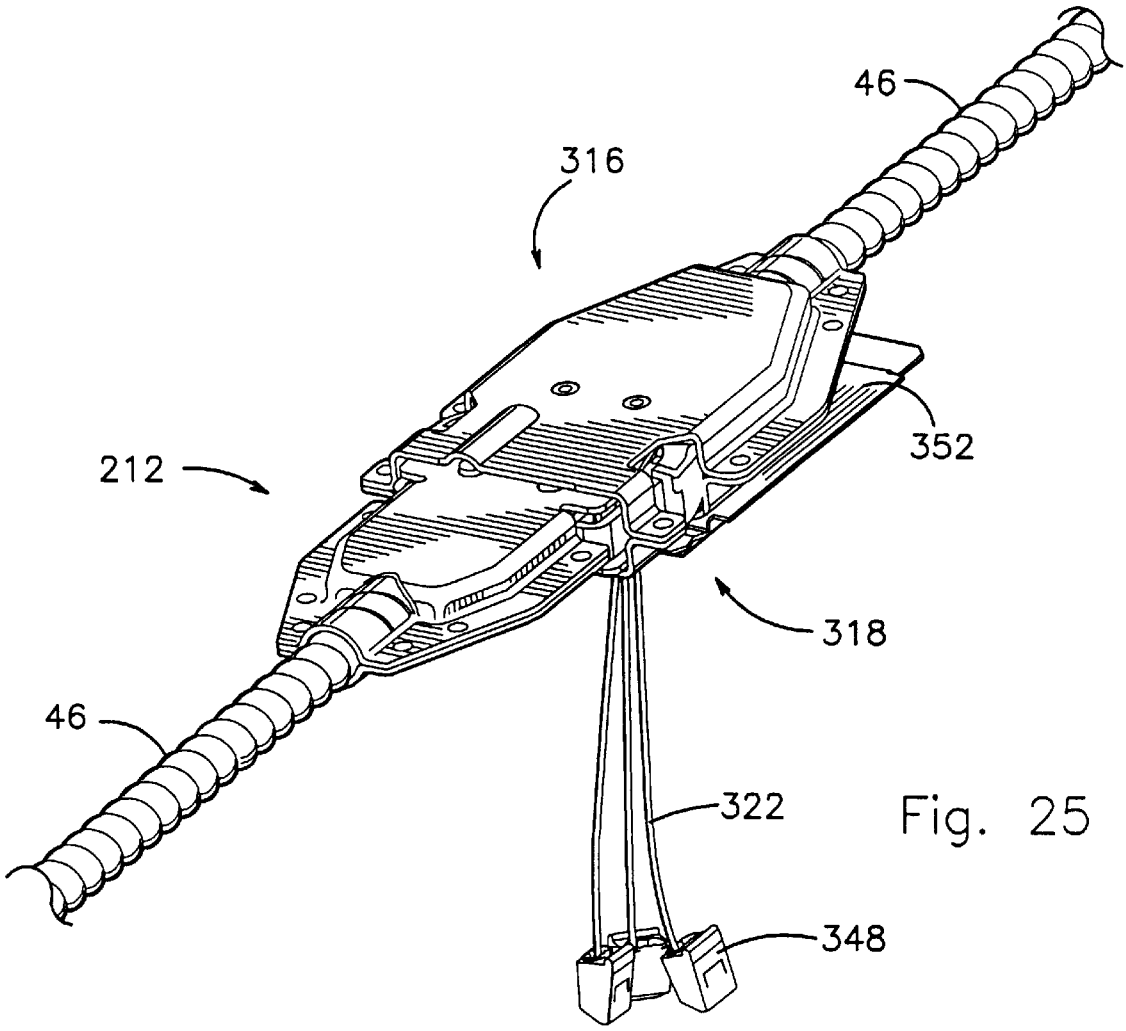
FIG. 25 is a perspective view illustrating the joining of the male connector head and female connector head of FIGS. 23 and 24.
Figure 26A:
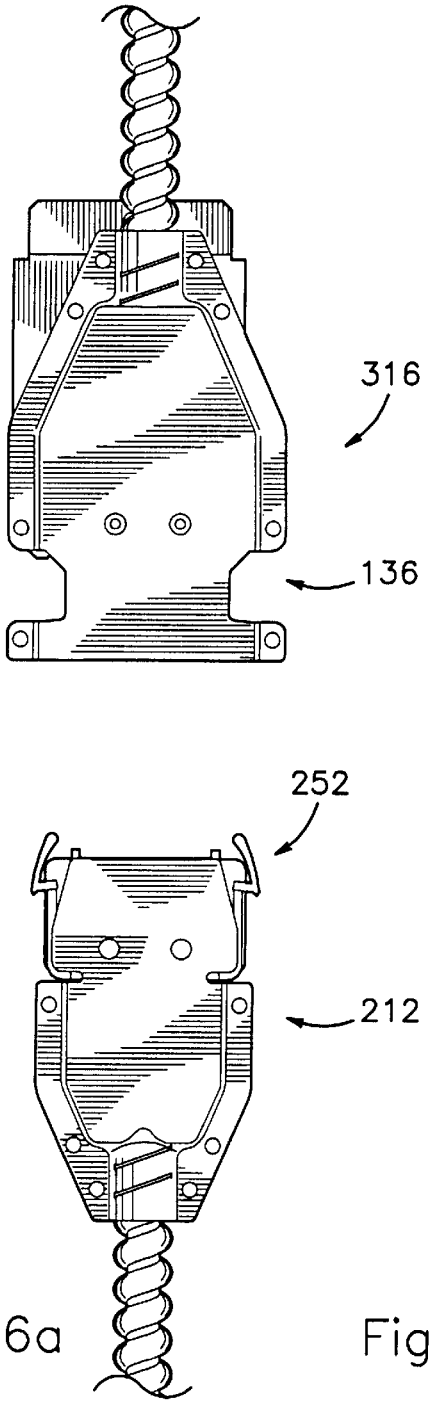
FIGS. 26A and 26B are detail plan views of the latching arrangement between the male connector head and the female connector head of FIGS. 23 through 25, FIG. 26A illustrating the arrangement of structure prior to connection and latching with FIG. 26B illustrating the arrangement of structure after latching.
Figure 26B:
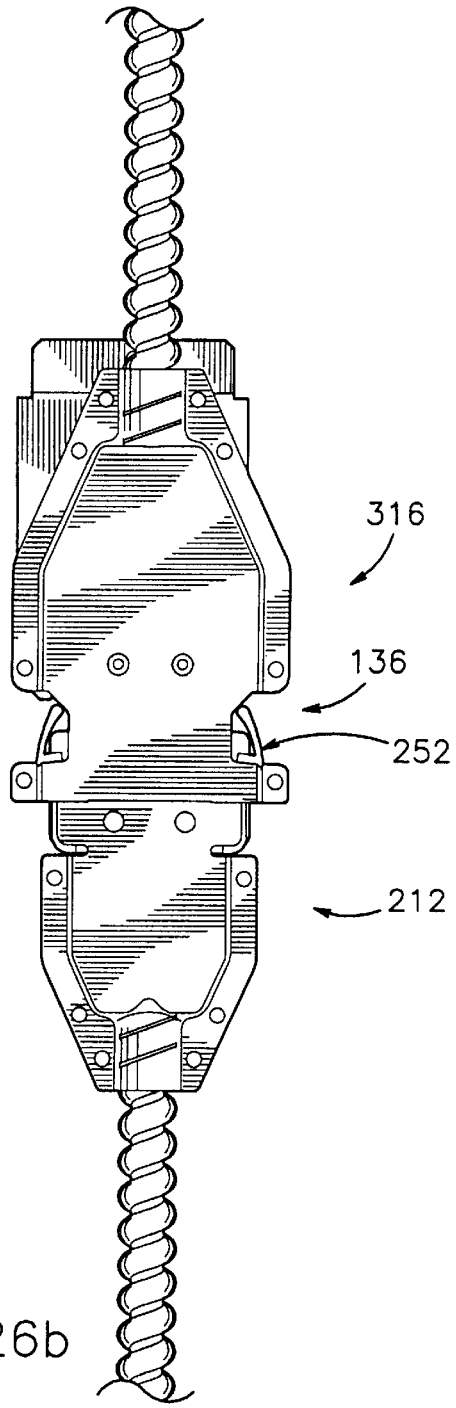

FIGS. 23 through 25 illustrate imminent connection and connection between the male connector head 212 and the female connector head 316. FIGS. 26A and 26B provide additional detail of the connection of the latch elements 252 within the notches 136 to show the positive connection therebetween.

Figure 28:
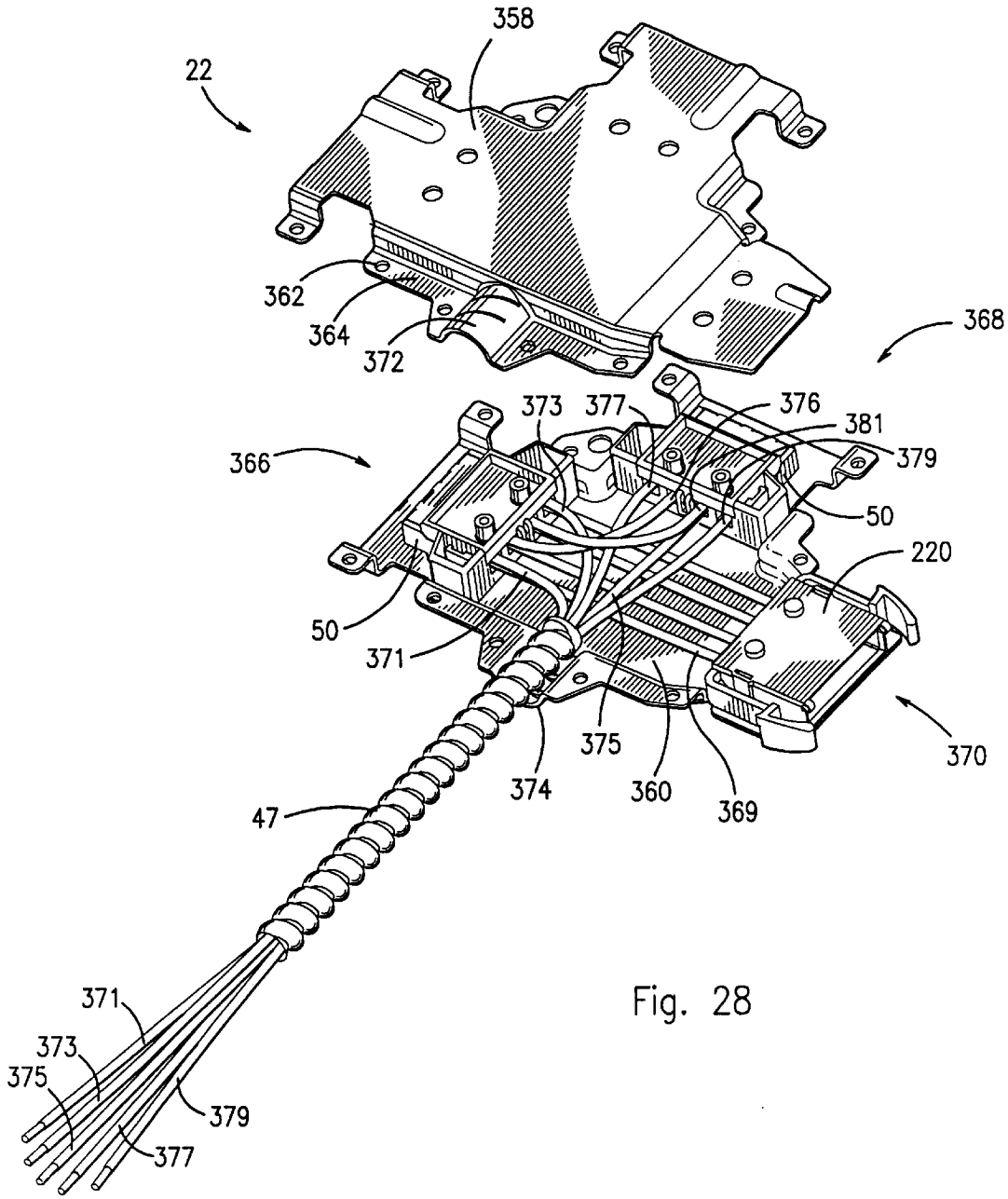
FIG. 28 is a perspective view of a switch drop wiring component of the invention.

Referring now to FIG. 28, the switch drop 22 is seen to comprise upper and lower housing plates 358 and 360 which when mated together and held by rivets (not shown) received through apertures 362 formed in flange portions 364 of the plates 358, 360, act to define female ports at 366 and 368 and a male port at 370. The housing plates 358 and 360 hold one each of the female terminal housings 50 at the female ports 366 and 368 while one of the male terminal housings 220 is held by the plates 358, 360 in the male port 370. The ports 366, 368 and 370 are keyed in a manner as described previously relative to other wiring components of the invention. The housing plates 358 and 360 further have upper and lower inlets 372 and 374 which mate on assembly of the plates 358, 360 to form a channel within which an end of a flexible metal conduit 47 can be received. In the variation of the switch drop 22 as shown, five conductors are carried by the conduit 47 and extend into the interior of the switch drop 22 for connection to terminals (not shown) housed by the female terminal housings 50 in the female ports 366 and 368.

The conductors function as switch legs 371 and 377 to form a first switch circuit (not otherwise shown) and as switch legs 373 and 379 to form a second switch circuit (not otherwise shown) with the conductor 375 functioning as a ground leg. Switch legs 371 and 373 connect to terminals (not shown) in the housing 50 of the female power port 366 as shown and are double crimped in a conventional manner with conductors identified as buss bars 369 which extend between the port 366 and the male port 370, power being carried from the male port 370 to the female port 366 through the buss bars 369. As is apparent from FIG. 28, the buss bars 369 connect to terminals (not shown) in the male housing 220 via conventional single crimping.

The switch legs 377 and 379 connect to terminals (not shown) in the housing 50 of the female switched port 368 as shown and are single crimped in a conventional manner to said terminals. The ground conductor 375 connects to a terminal in the housing 50 of the port 368 as shown and double crimps to a system ground jumper wire 381 in a conventional manner, the wire 381 extending into the female housing 50 of the port 366 as shown for double crimp connection to a terminal (not shown) within said housing with one of the buss bars 369. A system neutral jumper wire 376 connects to terminals (not shown) in the female housings 50 respectively of the ports 366 and 368, the wire 376 being singly crimped to a terminal (not shown) in the port 368 and being doubly crimped to a terminal (not shown) in the port 366 with one of the buss bars 369. In the arrangement shown, the female port 368 is a switched port while the female port 366 is an unswitched port, the switch drop 22 having double wall switching capability.

Other variations of the switch drop 22 exist including a single switch drop (not shown) having three conductors in the conduit 47, the conductors comprising two switch legs and a ground leg. In a single switch embodiment, the two female housings 50 would have corresponding chambers 178 empty. Further, the switch leg 371 would extend into the first chamber 178 in the left side of the female housing 50 in the port 368. A four-conductor switch drop (not shown) would locate a neutral leg in the "second from the left" chamber 178 in the female housing 50 of the port 368 with the neutral leg wire dropping directly down through the conduit 47.

Figure 29:
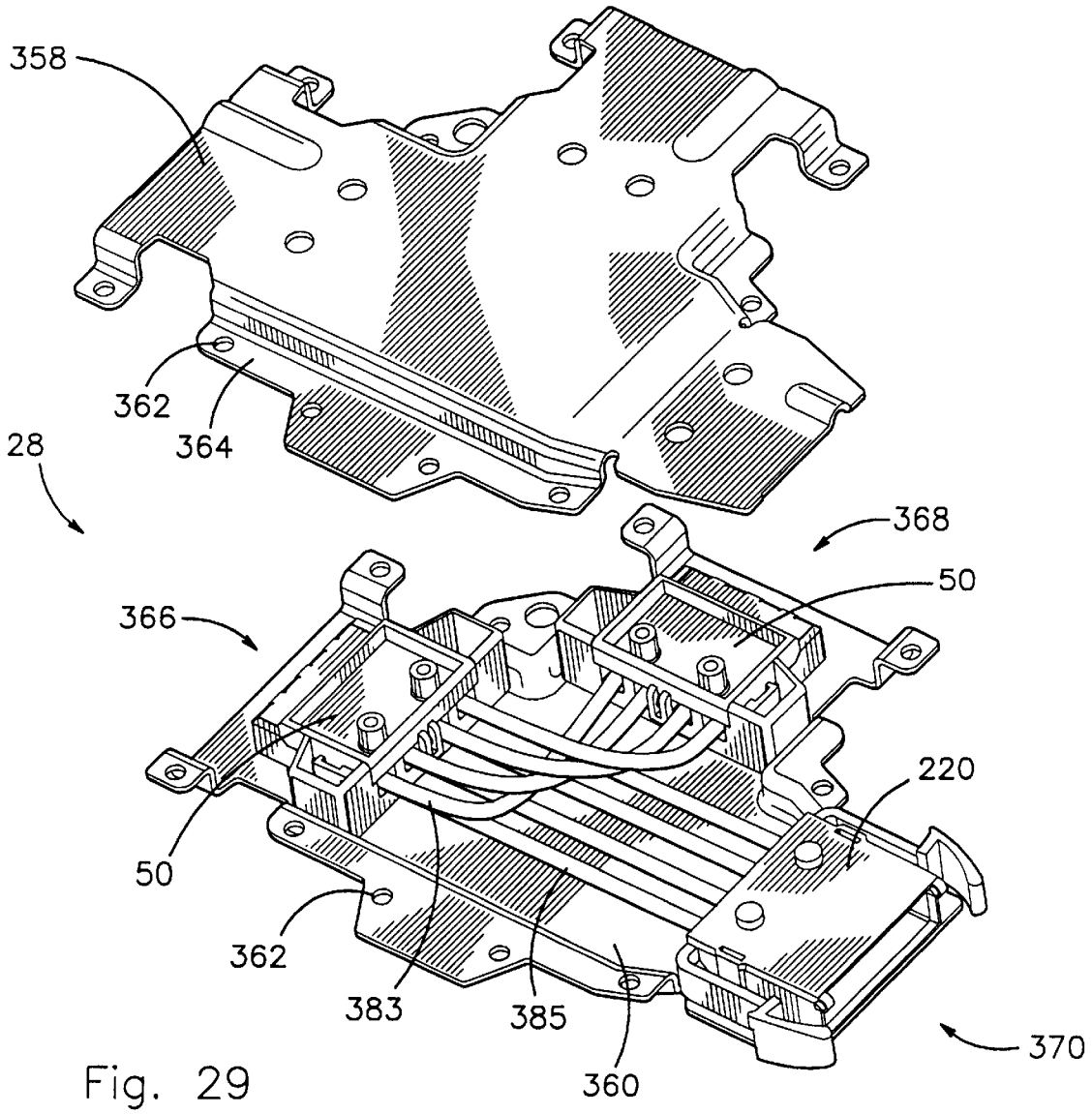
FIG. 29 is a perspective view of a three-port splitter wiring component of the invention.

Referring now to FIG. 29, the splitter 28 is seen to be essentially identical to the structure of FIG. 28 with the exception that an inlet channel such as would be formed by the upper and lower inlets 372, 374 of FIG. 28 are not formed in the structure since electrical conductors such as the conductor legs 371 through 379 of FIG. 28 do not enter the interior of the splitter 28. The upper and lower housing plates of the splitter 28 are otherwise substantially identical to the plates 358, 360 of the switch drop 22 and are therefore so numbered in a like manner as are most remaining portions of the splitter 328. Jumper wires 383 join the two female terminal housings 50 while buss bars 385 join the female port 366 with the male port 370. In the event that the plates 358, 360 of FIG. 28 are identical to the plates 358, 360 of FIG. 29, a blocking element (not shown) would be required to block ingress into the splitter 28 through the inlets 372, 374. The splitter 28 is intended to direct power through the buss bars 385 and to form a branch circuit in a second direction through use of the jumper wires 383. The splitter 28 is a male/female wiring component which can be used anywhere within the relocatable wiring systems of the invention. In essence, the splitter 28 splits power passing to the female port 366 from the male port 370 so that power is then directed in two directions.

Figure 32:
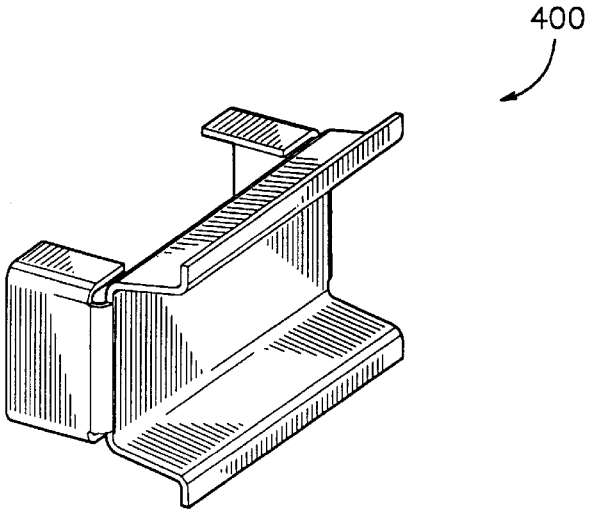
FIG. 32 is a perspective view of a dust cover.

Referring now to FIG. 32, a dust cover is seen at 400 to provide a protective expedient in the event that a port is not used in any one of the several component devices of the invention. The cover 400 fits into any one of the female ports to prevent entry thereinto of dust or other foreign matter. The system is configured such that a male port is never exposed and therefore does not need to be covered.

It is to be understood that the invention can be practiced other than as explicitly disclosed herein. Further, it is to be understood that structure not referred to in certain wiring components but which have the same function as similar or identical structure in other wiring components will function essentially as described relative to said other wiring componets. It is further to be understood that terminal elements housed by the female terminal housing 50 and the male terminal housing 220 can take the form of other terminal elements besides the female socket terminals 210 and the male terminals 222, these standard pin and socket terminal arrangements being chosen due to cost and simplicity of operation as well as effectiveness of operation for the discussion herein provided. It is further to be seen that the scope of the invention is to be defined essentially by the recitations of the appended claims.

What is claimed is:

1. A converter device useful in a relocatable wiring system, the system having lengths of cable carrying circuit conductors and connective devices one of which is connected to at least one end of the lengths of cable, the connective devices being connectable mechanically and electrically to form the system, the converter device being connectable at one end to at least one of the connective devices and at another end to a junction box having wiring connected electrically to a source of power, at least portions of the circuit conductors being disposed internally of the converter device and being connectable to the wiring within the junction box, the converter device comprising:

an exterior housing having a port opening at one end comprising a port and a wiring opening formed in another portion of the exterior housing;

a terminal housing carried by the exterior housing and disposed in adjacent relation to the port opening;

at least one electrical terminal mounted in the terminal housing and being mechanically and electrically connected to portions of the circuit conductors disposed internally of the exterior housing, portions of the circuit conductors extending through the wiring opening and into the interior of the junction box for connection to wiring within the junction box; and, compression fitting means disposed on the exterior housing about the wiring opening for mounting the converter device to the junction box.

2. The converter device of claim 1 wherein the exterior housing comprises an upper housing plate and a lower housing plate and means for mating the plates together to form the exterior housing, the compression fitting means comprising an arcuate neck element extending from one of the plates at an end thereof opposite the port opening, the neck element having a rib having an arcuate contour formed on an exteriorly disposed surface thereof and being raised above said surface, the arcuate contour of the rib being congruent with the arcuate contour of the neck element, the neck element further having an aperture formed therein inwardly of the rib, a screw having threads and being received for tightening and loosening effect within the aperture, on rotation of the screw a distal end of the screw extending inwardly of the neck element, the other of the housing plates having a semi-cylindrical neck element extending from an end thereof opposite the port opening, the semi-cylindrical neck element mating with the arcuate neck element on mating of the plates together to form a substantially cylindrical neck, the semi-cylindrical neck element having plate means formed about the wiring opening and disposed internally of the neck for providing a surface against which the distal end of the screw can be biased by rotation of the screw to expand portions of the neck elements apart, thereby to positively mount the neck into an opening formed in the junction box.

3. The converter device of claim 2 wherein the plate means comprise a plate element connected to the semi-cylindrical neck element for movement relative thereto on biasing of the plate means by the screw, the plate element being disposed essentially within the wiring opening and having an access opening formed therein through which the wiring extends externally of the converter device, the plate element terminating in a body member joined to said plate element and extending at an angle to the plate element and into interior portions of a chamber defined by the neck, the body member having a depression formed therein and having apron plates formed one each on lateral sides thereof, the semi-cylindrical neck element having a ramp element formed on a peripheral portion thereof adjacent the plate element, a ramp element being inserted into a knock-out opening of the junction box and the neck pivoted to engage the rib formed on the arcuate neck element with peripheral edges of the knock-out opening to snap-fit the neck into the knock-out opening, inward motion of a distal end of the screw biasing said distal end against opposite convex surfaces of the depression formed in the upper surface of the body member, thereby to expand peripheral edges of the neck elements within the knock-out opening and to positively mount the converter device to the box.

4. The converter device of claim 1 wherein the port of the converter device comprises a female port connectable to a male port of any of the connective devices.

5. The converter device of claim 4 wherein the exterior housing has notches formed adjacent the female port, the connective devices having male ports having latch arms disposed one each on each side of the male port for engagement with one each of the notches, thereby to latch the connective device to the converter device through connection between respective male and female ports.

6. The converter device of claim 1 wherein the terminal housing comprises at least one chamber into which one of the electrical terminals is placed to maintain said electrical terminal in a functional location relative to the port opening, and mounting means formed integrally with the terminal housing for receiving the electrical terminal and for mounting the electrical terminal within the terminal housing.

7. The converter device of claim 6 wherein the terminal housing is formed of at least two body portions mateable together to form an enclosure within which the electrical terminal is mated, the body portions locking together on mating therebetween to hold the body portions together and to hold the electrical terminal in place between the body portions.

8. The converter device of claim 1 and further comprising retention means for preventing the electrical terminal from being displaced axially from the housing.

9. The converter device of claim 7 and further comprising means carried by the body portions and mateable to define the chamber within which the electrical terminal is disposed.

10. The converter device of claim 1 and further comprising retention means formed integrally with the terminal housing for preventing the electrical terminal from being displaced axially from the terminal housing.

11. The converter device of claim 10 wherein the retention means at least partially define the chamber within which the electrical terminal is disposed.

12. The converter device of claim 1 wherein a plurality of the electrical terminals are mounted in the terminal housing.

13. The converter device of claim 1 wherein the exterior housing has apertures formed therein and the terminal housing has posts formed thereon, the posts being received within the apertures respectively to locate the terminal housing relative to the port opening.

14. In a relocatable wiring system having lengths of cable carrying circuit conductors and connective devices connected to at least one end of the lengths of cable, the connective devices being mechanically and electrically connectable to form the system, the improvement comprising hardwire interface means for connecting to hardwire terminating in an electrical box, the interface means being connectable to at least certain of the connective devices, the interface means having an opening through which portions of the circuit conductors extend and which further extend into an opening formed in the box, the interface means further comprising an exterior housing having a port opening at one end comprising a port and a wiring opening formed in another portion of the exterior housing, a terminal housing carried by the exterior housing and disposed in adjacent relation to the port opening and at least one electrical terminal mounted by the terminal housing and being mechanically and electrically connected to portions of the circuit conductors disposed internally of the exterior housing, portions of the circuit conductors extending through the wiring opening and into the interior of the junction box for connection to the wiring within the junction box; and compression fitting means carried by the interface means for mounting the interface means to the junction box.

15. In the relocatable wiring system of claim 14 wherein the exterior housing comprises an upper housing plate and a lower housing plate and means mating the plates together to form the housing, the compression fitting means comprising a neck element having an arcuate contour extending from one of the plates at an end thereof opposite the port opening, the neck element having a rib having an arcuate contour formed on an exteriorly disposed surface thereof and being raised above said surface, the arcuate contour of the rib being congruent with the arcuate contour of the neck element, the neck element further having an aperture formed therein inwardly of the rib, a screw having threads which are received for tightening and loosening effect within the aperture, a distal end of the screw extending inwardly of the neck element, the other of the housing plates having a semi-cylindrical neck element extending from an end thereof opposite the port opening, the semi-cylindrical neck element mating with the arcuate neck element on mating of the plates together to form a substantially cylindrical neck, the semi-cylindrical neck element having plate means formed about the wiring opening and disposed internally of the neck for providing a surface against which the distal end of the screw can be biased by rotation of the screw to expand portions of the neck elements apart, thereby to positively mount the neck into an opening formed in the junction box.

16. In the relocatable wiring system of claim 15 wherein the plate means comprise a plate element connected to the semi-cylindrical neck element for movement relative thereto on biasing of the plate means by the screw, the plate element being disposed essentially within the wiring opening and having an access opening formed therein through which the wiring extends externally of the converter device, the plate element terminating in a body member joined to said plate element and extending at an angle to the plate element and into interior portions of a chamber defined by the neck, the body member having a depression formed therein and having apron plates formed on each lateral side thereof, the semi-cylindrical neck element having a ramp element formed on a peripheral portion thereof adjacent the plate element, the ramp element being inserted into the knock-out opening of the junction box and the neck pivoted to engage the rib formed on the arcuate neck element with peripheral edges of the knock-out opening snap-fitting the neck into the knock-out opening, tightening of the screw causing biasing of the distal end of the screw against opposite, convex surfaces of the depression formed in the opposite surface of the body member, thereby to expand peripheral edges of the neck elements within the knock-out opening and to positively mount the converter device to the box.

17. In the relocatable wiring system of claim 14 wherein the port comprises a female port connectable to a male port of any of the connective devices.

18. In the relocatable wiring system of claim 14 wherein a plurality of the electrical terminals are mounted by the terminal housing.

19. In the relocatable wiring system of claim 14 wherein the terminal housing comprises at least one chamber into which one of the electrical terminals is placed to maintain said electrical terminal in a functional location relative to the port opening, and mounting means formed integrally with terminal housing for receiving the electrical terminal and for mating the electrical terminal within the terminal housing, the terminal housing being formed of at least two body portions mateable together to form an enclosure within which the electrical terminal is mounted, the body portions locking together on mating therebetween to hold the body portions together and to hold the electrical terminal in place between the body portions.

* * * * *